US005901383A

United States Patent [19]

Yanagawa et al.

[11] Patent Number: 5,901,383

[45] Date of Patent: May 11, 1999

[54] SUPPORT STRUCTURE FOR A TOILET COVER UNIT

[75] Inventors: Yasuhiro Yanagawa; Tetsuo Nishimoto; Hiroshi Matsuo; Akio Fujii, all of Kitakyushu; Akihiko Nakajima; Takao Sakama, both of Yokohama, all of Japan

[73] Assignees: Toto Ltd., Fukuoka; Koito Industries, Ltd., Kanagawa, both of Japan

[21] Appl. No.: 08/666,283

[22] PCT Filed: Dec. 26, 1994

[86] PCT No.: PCT/JP94/02231

§ 371 Date: Sep. 19, 1996

§ 102(e) Date: Sep. 19, 1996

[87] PCT Pub. No.: WO95/17844

PCT Pub. Date: Jul. 6, 1995

[30] Foreign Application Priority Data

| | | | |
|---|---|---|---|
| Dec. 27, 1993 | [JP] | Japan | 5-353194 |
| Aug. 31, 1994 | [JP] | Japan | 6-232233 |

[51] Int. Cl.[6] ..... A47K 13/12

[52] U.S. Cl. ..... 4/236; 4/248

[58] Field of Search ..... 4/236, 240, 246.1, 4/248

[56] References Cited

U.S. PATENT DOCUMENTS

| | | | |
|---|---|---|---|
| 2,333,732 | 11/1943 | Morris | 4/240 |
| 3,802,000 | 4/1974 | Waldon | 4/236 |

FOREIGN PATENT DOCUMENTS

| | | |
|---|---|---|
| 61-49041 | 3/1986 | Japan . |
| 62-84720 | 4/1987 | Japan . |
| 63-13927 | 1/1988 | Japan . |
| 2-63424 | 3/1990 | Japan . |
| 2-107398 | 8/1990 | Japan . |
| 3-127597 | 12/1991 | Japan . |
| 4-3098 | 1/1992 | Japan . |
| 4-19295 | 2/1992 | Japan . |
| 483100 | 3/1992 | Japan . |
| 5-21798 | 3/1993 | Japan . |
| 5-25517 | 6/1993 | Japan . |
| 5-68396 | 9/1993 | Japan . |
| 06277164 | 10/1994 | Japan . |

*Primary Examiner*—Robert M. Fetsuga
*Attorney, Agent, or Firm*—Beyer & Weaver, LLP

[57] ABSTRACT

The slide support base 62 protrudes from the supporting wall 56 of the support recess 52 in the casing main body 14 and the tube-shaped support part 122 on the side of the toilet lid 100 is supported by and capable of sliding over its cylindrical surface 65*a*. The rotational pin 70 of the viscous resistance mechanism 80 protrudes from slide support base 62 and the rotational pin 70 fits in the fitting recess 132 on the side of the toilet lid 100. That is, the toilet lid 100 is pivotably supported to the casing main body 14 by two support structures. To remove the toilet lid 100 from the casing main body 14, the toilet lid is raised to the upright position and then applied with upward force to be pulled out. Since the opening 124 and the opening 136 are formed in the tube-shaped support part 122 and the fitting recess 132, the toilet lid 100 is removed from the casing main body through them.

13 Claims, 20 Drawing Sheets

SUPPORT STRUCTURE FOR A TOILET COVER UNIT

BACKGROUND OF THE INVENTION

1. Field of the Invention

The present invention relates to a support structure for a toilet cover unit, by which the toilet cover unit that comprises a toilet seat and/or a toilet lid is supported while being raised or lowered freely against the toilet bowl main body.

2. Description of the Related Art

As the conventional support structure for toilet seats and/or toilet lids of this type, a device for cleaning facilitation by removal of the toilet seat or toilet lid from the toilet bowl has been proposed previously; an example of the known art is in the Japanese Patent Laying-open Gazette 61-49041 (1986). FIG. 23 is a perspective view drawing showing a western-style toilet bowl with some part of it cut away, and FIG. 24 is a lateral side drawing of and around a pivotable attachment part of the toilet seat and the toilet lid. In these figures, a western-style toilet bowl 500 is equipped with a sanitary washing unit 504 which has a wash water nozzle 502 to spray washing water. A toilet seat 508 is attached to the inside recesses of the main body 506 of the sanitary washing unit 504 by a pivotable shaft 512 so as to pivot freely. A toilet lid 520 is pivotably attached to the lateral surfaces of both ends of the pivotable shaft 512 by an elastically deformable attachment part 522. The attachment part 522 has a slide hole 526 which supports the pivotable shaft 512 so that it slides freely, and an opening 528 which is a cutaway matching the slide hole 526; the opening 528 is pressed open wider through elastic deformation to allow the pivotable shaft 512 to support the slide hole 526. The toilet lid 520 is thus pivotably attached to the main body 506 and detachable from the pivotable shaft 512 through the opening 528.

The attachment structure of the toilet lid 520, however, adopts the construction where the attachment part 522 is opened wider by the elastic deformation of the opening 528; therefore, the pivotable shaft 512 is difficult to be pressure-inserted into the opening 528 if the attachment part 522 is made excessively stiff for support whereas the strength of the attachment part 522 is degraded if the detachability of the toilet lid 520 is facilitated. Therefore, the construction of the attachment part 522 cannot simultaneously solve the problems of compatibility between a solid support and the facilitated attaching-detaching operations. Such problems as above also arise if the detachable structure of the toilet lid 520 is applied to the toilet seat 508.

A rotational-force resistance mechanism, where a resistant force is applied to the toilet seat, or the toilet lid, during pivotal movement in the lowering direction so as to descend slowly, has been known. This rotational-force resistance mechanism can improve the operational facility because the toilet seat or the toilet lid descends slowly when it is lowered.

However, no western-style toilet bowl which has both such a rotational-force resistance mechanism and a structure where the toilet seat or the toilet lid is easily attached and detached has been known.

The rotational-force resistance mechanism has a structure where the resistant force is generated through transmitting an applied energy of a spring or viscous resistance to the pivotable shaft; therefore, there has been a problem that trouble tends to be caused by the deformation of the parts such as the pivotable shaft if a large external force is applied to the toilet seat or the toilet lid and then transmitted to the pivotable shaft at the time of conveyance.

SUMMARY OF THE INVENTION

The present invention is purposed to provide a support structure for a toilet cover unit, at least inclusive of the toilet seat or a toilet lid, where the toilet cover unit is supported against the support main body secured to the toilet bowl main body with a resistant force applied to the pivotal movement in the lowering direction and with facilitated attaching-detaching performances.

The toilet cover unit related to the present invention, such as a toilet seat and/or a toilet lid, is supported against the support main body with a rotatable support component and a support receiving part in between so as to be pivoted freely with the shaft core as the pivoting axis. The rotatable support component is linked to a rotational-force resistance device. The rotational-force resistance device applies a resistant force in the lowering direction as for the toilet cover unit; and thus the toilet cover unit is lowered slowly to close.

To remove the toilet cover unit from the support main body, the toilet cover unit is positioned at a prescribed angle and then applied with a force to pull it at the prescribed angle. Since the engagement of the rotatable support component and the support receiving part which exist between the toilet cover unit and the support main body can be engaged or disengaged when they are positioned at the prescribed angle, the toilet cover unit is easily removed from the support main body.

Removability of the toilet cover unit from the support main body is convenient when cleaning the toilet cover unit and the toilet bowl main body and is also effective in the following way. That is, although the toilet cover unit is linked to the rotational-force resistance device by way of the rotatable support component, if an impact is applied to the toilet cover unit during conveyance or any other occasion, the external force is transmitted to the rotational-force resistance device and will cause trouble. The present invention, however, where the rotatable support component and the support receiving part are quickly engaged and disengaged, can prevent impact to the rotational-force resistance device by removing the toilet cover unit from the support main body.

Besides the rotatable support component and the support receiving part, a hinge unit may be inserted between the support main body and the toilet cover unit. The hinge unit will prevent a torsional force or any other external force and an overload to be applied to the rotational-force resistance device linked to the rotatable support component by holding the toilet cover unit so as to allow free pivotal movement against the support main body. Since the hinge unit will simultaneously release the engagement state of the support main body and the toilet cover unit when the toilet cover unit is positioned at the prescribed angle, in other words, at the position where the rotatable support component and the support receiving part become engaged or disengaged, no troublesome operations are required when removing the toilet cover unit from the support main body.

Moreover, a preferred form of the hinge unit may be constructed with a fixed-side support component and a supporting tube part. The fixed-side support component is of a rectangular shape with a round top and bottom which comprises a cylindrical surface, and the cylindrical surface pivotably supports the supporting tube part. A cutaway part is formed in the supporting tube part, and the engagement of the fixed-side supporting component and the supporting tube part is disengaged when the cutaway part is positioned to the narrow part of the rectangular shape with a round top and bottom.

A lock mechanism may also be located between the toilet cover unit and the support main body. The lock mechanism has a lock engagement part which is positioned between the toilet cover unit and the support main body, which prevents the toilet cover unit from detached from the support main body. The lock engagement part is released from the state existing between the toilet cover unit and the support main body by an operation at the lock operation part. Therefore, since the toilet cover unit cannot be removed from the support main body without operation of the lock operation part of the lock mechanism, the inconvenience of the toilet cover unit becoming removed unintentionally is avoided.

It is desirable that the lock operation part of the lock mechanism be located at a place at which manual operation is possible from the outside when the toilet cover unit is positioned at the prescribed angle and which is hidden behind the toilet cover unit when the toilet cover unit is not positioned at the prescribed angle. Since this disables operation from the outside when the toilet cover unit is not raised to the prescribed angle, unintended operation of the lock mechanism is prevented and the toilet cover unit is not removed from the support main body by the external force applied to the toilet cover unit. The prescribed angle at which the toilet cover unit can be removed from the support main body is not specifically designated, but the following preferable effects are available when it is set to approximately 90 degrees which is the state where the toilet cover unit is raised upright to the toilet bowl main body. That is, when the toilet cover unit is in the almost upright state to the toilet bowl main body, the toilet cover unit is in the position where a large external force is less frequently applied if compared with the state where a person is seated, and thus unintended disconnection from the support main body is prevented.

Moreover, by the interlinkage structure of the toilet seat and the toilet lids the toilet seat and the toilet lid are simultaneously attached to or detached from the support main body, but the toilet lid which is linked to the toilet seat will not be easily disconnected while a person is seated on the toilet seat.

At least either of the toilet seat and the toilet lid is involved as the toilet cover unit and, if both of them are involved, it is preferable to adopt the structure as shown below. That is, where as a first resistant support device is inserted between the toilet seat and the support main body, a second resistant support device is also inserted between them. The first and the second resistant support devices are placed on the same shaft core. Thus, the toilet seat and the toilet lid pivot with the same shaft core as pivoting axis and, together with this, a resistant force is applied to the pivotal movement in the descending direction. Since the shaft core is the same, both the toilet seat and the toilet lid are removed simultaneously at the prescribed angle.

As for the first and the second resistant support devices, if their resistant forces are set so that the toilet lid pivoting speed generated by the resistant force of the second resistant support device is slower than the toilet seat pivoting speed generated by the resistant force of the first resistant support device, an overload is not applied to the second resistant support device when the toilet seat and the toilet lid are pivoted simultaneously in the descending direction because the descending direction force of the toilet lid is not applied to the toilet seat.

The means for applying the resistant force of the rotational-force resistant device may be a single use or the combined use of viscous resistance, springs and other devices; and the following additional effect results from the use of springs. That is, in an application of springs where the applied energy is stored in the state that the toilet lid is fully lowered to the toilet bowl main body, trouble and a decrease in the service life are caused by the excessive impact applied to the springs during conveyance Therefore, the applied energy of the springs is relieved if the toilet cover unit is removed from the support main unit, and thus no impact is applied to the springs during conveyance and their service life will not be decreased.

DESCRIPTION OF THE PREFERRED EMBODIMENT

Figure 1:
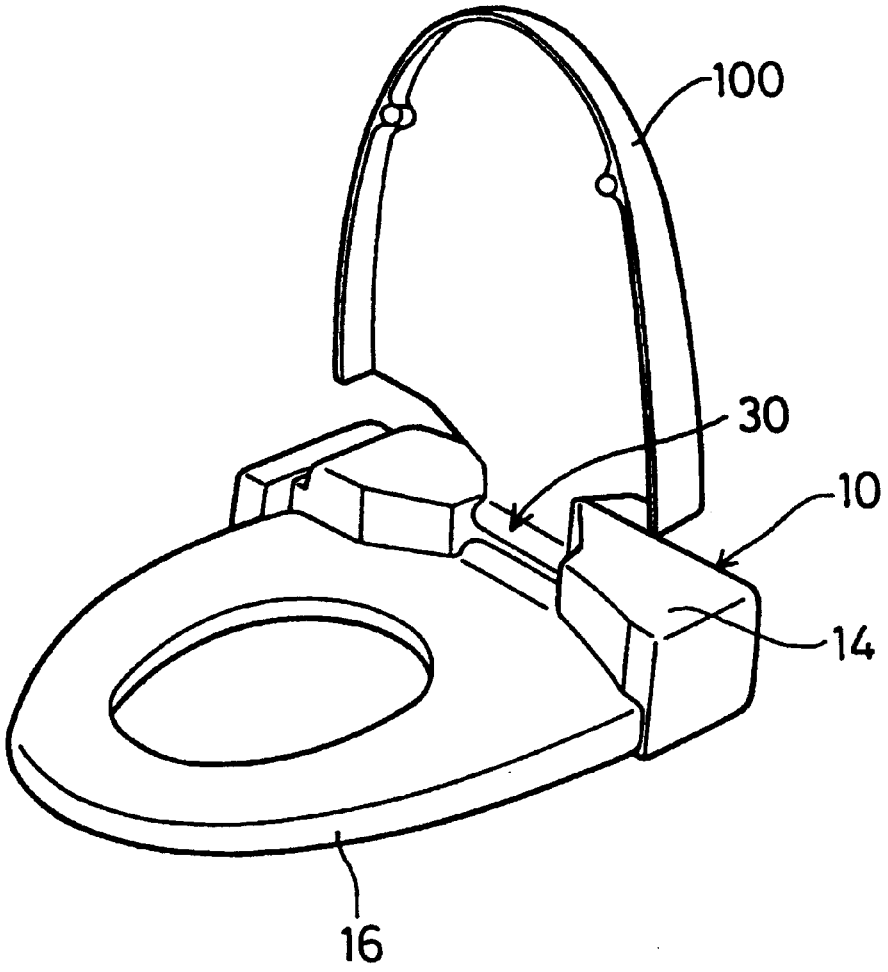
FIG. 1 is a perspective view drawing of a sanitary washing unit which comprises a toilet lid support structure related to an embodiment of the present invention.
Figure 2:
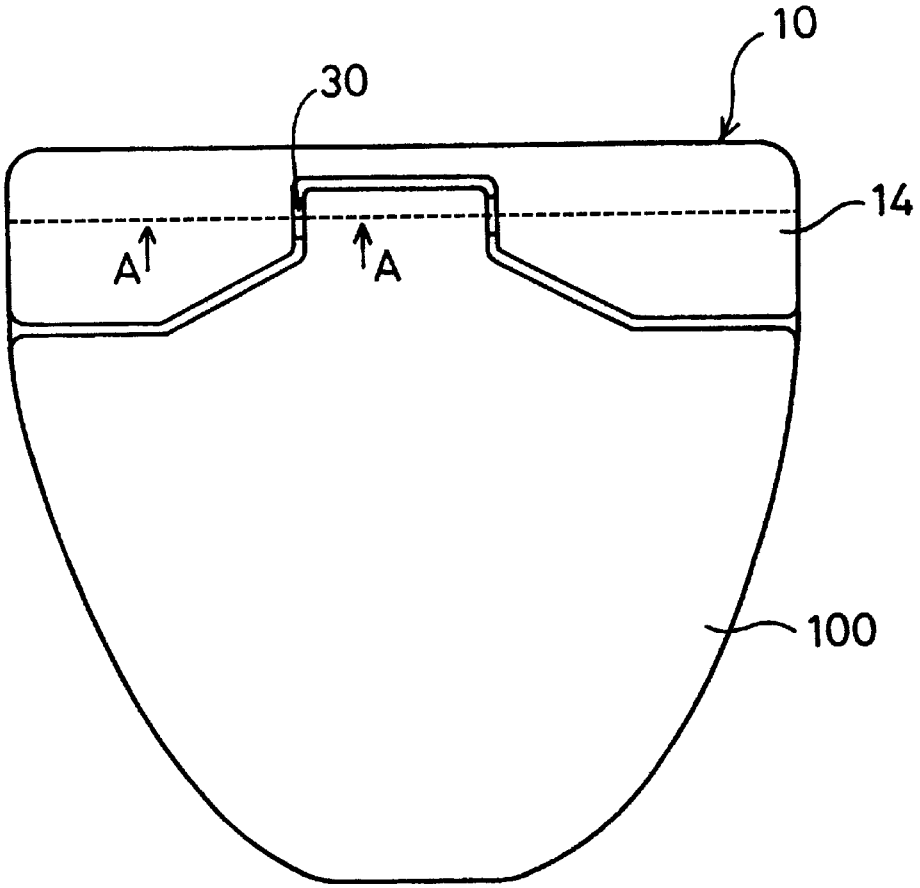
FIG. 2 is a plan of the sanitary washing unit.

For further elucidation of the construction and effects of the present invention described above, the following paragraphs describe the preferred embodiments of the invention. FIG. 1 is an external view drawing of a sanitary washing unit mounted with a toilet cover unit. The toilet cover unit includes a toilet set or a toilet lid. The toilet lid and the toilet seat each also being referred to as a toilet cover plate. FIG. 2 is its plan.

The entire construction of a sanitary washing unit 10 shown in FIG. 1 is described below first. This sanitary washing unit 10 is to be mounted on a western-style toilet bowl (not shown in the figure), which comprises a casing main body 14, a water temperature control device which is stored inside the casing main body 14 and designed for heating the washing water and discharging the water at a setup temperature (not shown in the figure), a washing nozzle unit which sprays washing water heated to the setup temperature by the water temperature control device toward a private part, and an operation part.

Figure 3:
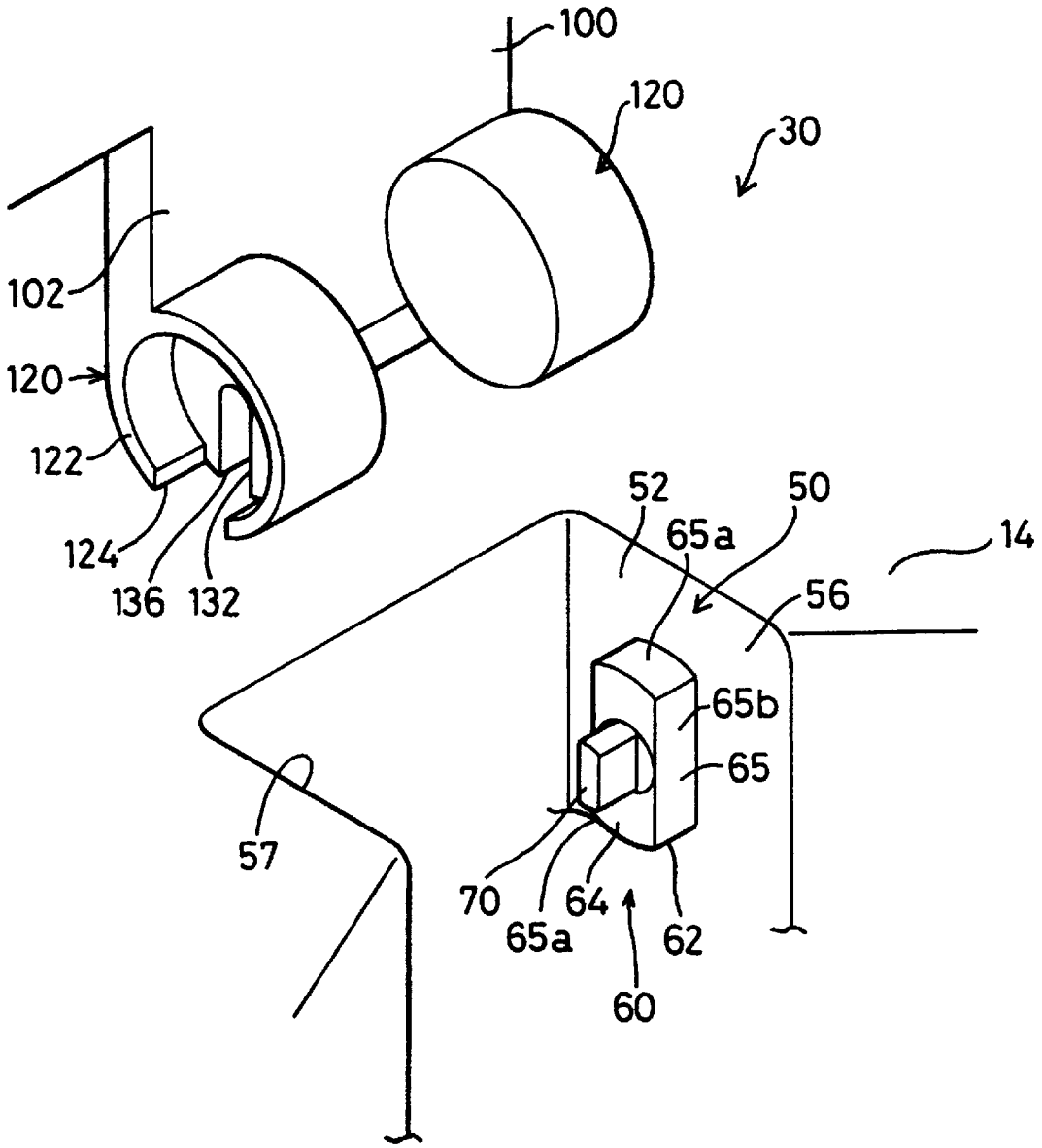
FIG. 3 is a perspective view drawing of a state where the toilet seat is removed from the casing main body.

A toilet lid 100 is detachably attached to the casing main body 14 by way of a toilet lid support mechanism 30. FIG. 3 is a perspective view drawing showing a state where the toilet lid 100 is removed from the casing main body 14. The toilet lid support mechanism 30 comprises a supporting mechanism 50 on the side of the casing main body 14 and a support receiving mechanism 120 on the side of the toilet lid 100. The supporting mechanism 50 is located in a support recess 52 at the center front of the casing main body 14 and the main component is a main body supporting part 60, each of which protrudes from a supporting wall 56 or 57 of the support recess 52 so as to face each other. Although FIG. 3 shows the main body supporting part 60 formed on the supporting wall 56 only, the main body supporting part on the supporting wall 57 is of the same construction as the supporting part 60 and thus the description is eliminated.

The main body supporting part 60 comprises a slide support base 62 and a rotational pin 70 which protrudes from the slide support base 62. The slide support base 62 is formed with a facing surface 64 and outer surfaces 65, and the outer surfaces 65 which are the top and bottom cylindrical surfaces 65*a* and both the vertical surfaces 65*b* form a shape which has a rectangular section with a round top and bottom. The rotational pin 70 protrudes from the facing surface 64. The rotational pin 70 is of a downsized similar figure of the slide support base 62, which composes a part of the viscous resistance mechanism 80 (FIG. 4) which is built inside the casing main body 14 and the main body supporting part 60.

Figure 4:
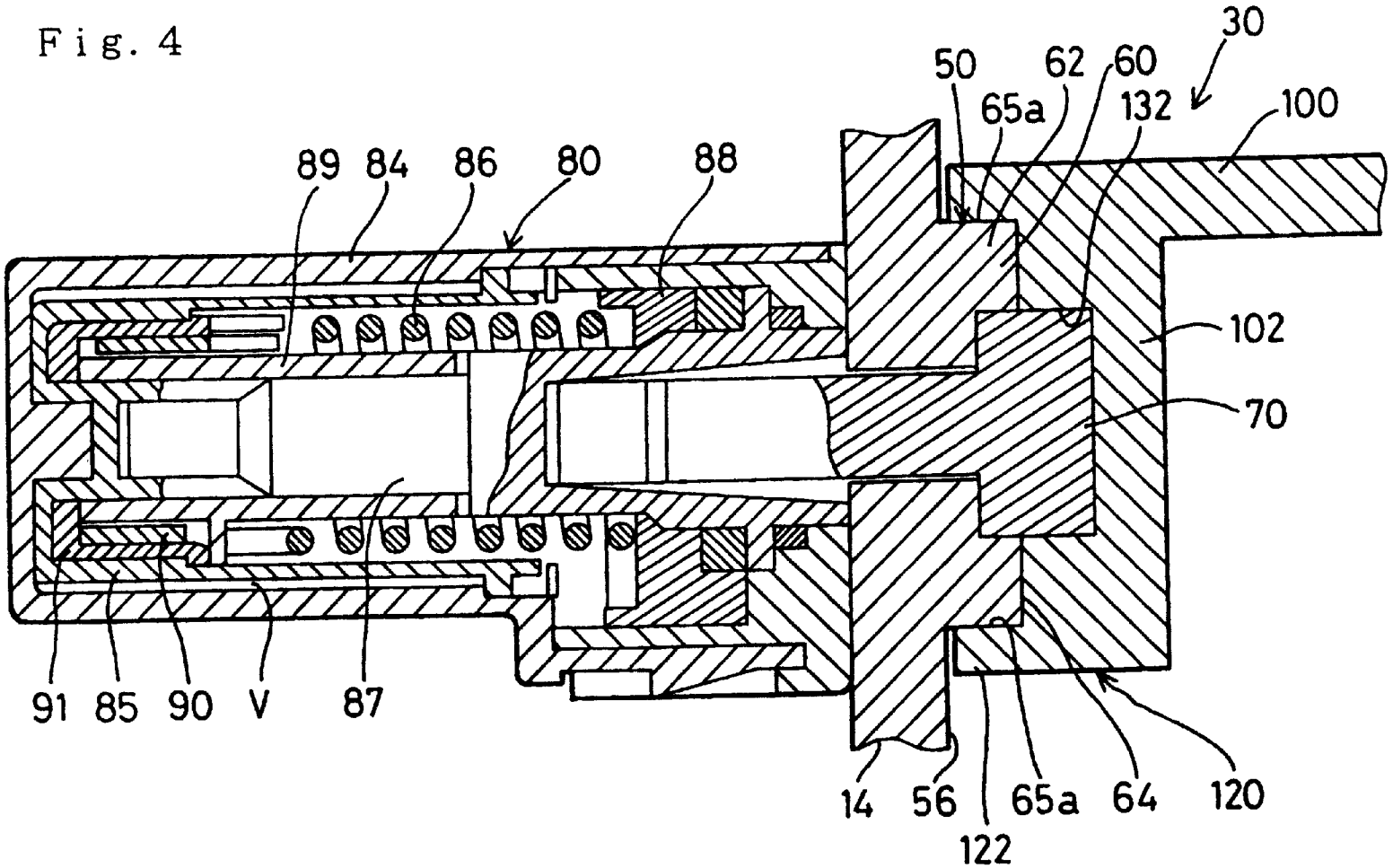
FIG. 4 is a sectional drawing showing a toilet lid support structure and a viscous resistance mechanism.

The article on the Japanese Utility Model Laying-open Gazette H4-83100 (1992) can be applied to for the viscous resistance mechanism 80; the construction is briefly described below: FIG. 4 is a sectional drawing showing the area around the viscous resistance mechanism 80 along the line A—A in FIG. 2. As FIG. 4 shows, the viscous resistance mechanism 80 is a mechanism where the rotational pin 70 is rotated slowly in the lowering direction by the viscous resistance and the spring resistance.

The viscous resistance mechanism 80 comprises a casing 84, a rotator 85 a part of which is pivotably supported by the bottom of the casing 84, a joint 87 which the rotational pin 70 is inserted into and supported by and which is pivotably supported by the other end of the rotator 85, a cam 88 which is engaged with an end face of the joint 87, a transmitter 89 which the joint 87 is inserted into, a coil spring 86 which is wound around the outer round surface of the joint 87 and which links the cam 88 and the transmitter 89, a clutch spring 90 which is movably joined with the transmitter 89 but secured to the same transmitter 89 by an end of it, and a shoe 91 which is inserted between the clutch spring 90 and the rotator 85 and secured by the rotator 85. A viscous material V is filled in the space between the inner round surface of the casing 84 and the outer round surface of the rotator 85.

The cam 88 engages the joint 87 but in a prescribed angle range, for example in the 30 degrees from the fully raised position of the toilet lid 100. The transmitter 89 is a tube-shaped component and into which the joint 87 is inserted so as to rotate freely. The shoe 91 rotates with the rotator 85 as a single unit when a frictional rotary force is received from the clutch spring 90. The coil spring 86 is secured by the cam 88 at an end of it and secured by the transmitter 89 at the other end to transmit the rotary force to the cam 88 to the transmitter 89, and energy is applied in the winding direction when the toilet lid 100 is fully lowered.

The next paragraphs describe the actions of the viscous resistance mechanism 80.

When the toilet lid 100 is fully lowered, the coil spring 86 is in the state where it is wound up and applied with energy. The clutch spring 90 is in the retracted state where its inner round surface is wound so as to contact the outer round surface of the transmitter 89 and is separated from the inner round surface of the shoe 91. Therefore, with the clutch spring 90 isolated from the rotator 85, the rotational pin 70, the joint 87 and the transmitter 89 are in the free state as for the rotator 85.

When a force in the upright position direction is given in the state where the toilet lid 100 is fully lowered, the rotational pin 70 rotates with the joint as a single unit. The rotational force of the joint 87 is applied by way of the cam 88 to the coil spring 86 in the untwisting direction, and this action unwinds the coil spring 86 and simultaneously rotates the transmitter in the same direction.

Thus following the rotation of the transmitter 89, the outer diameter of the clutch spring 90 becomes increased by receiving its unwinding force. When the toilet lid is raised to the upright position, the outer round surface of the clutch spring becomes pressed to the inner round surface of the shoe 91 and then the transmitter 89 is linked with the rotator 85.

In the process of raising the toilet lid 100 to the upright position, since the clutch spring 90 is separated from the rotator 85, the rotational force of the rotational pin 70 is not transmitted to the rotator 85 by way of the cam 88, the coil spring 86 and the transmitter 89 and thus the side of the rotational pin 70 is free from the resistance of the viscous agent V. Consequently, the resistant force is small when the toilet lid 100 is raised to the upright position. When the toilet lid 100 is fully lowered, since the coil spring 86 is wound and applied with energy, the pivotal force of the toilet lid 100, being applied so as to unwind in the direction opposite to the winding direction, does not become a large resistance at the time of raising the toilet lid 100.

When the toilet lid 100 is lowered from the upright positions the transmitter 89 does not rotate until the prescribed angle of the toilet lid (for example, 30 degrees) since the joint 87 is not engaged by 88 and thus the rotational force is not transmitted to the side of the coil spring 86. Therefore, the toilet lid 100 pivots quickly without resistance until the prescribed angle is reached When the toilet lid is lowered beyond the prescribed angle (30 degrees), the transmitter 89 rotates by way of the rotational pin 70, the joint 87, the cam and the coil spring 86. By the rotation of the transmitter 89, the clutch spring 90 also rotates as a single unit. Since the clutch spring 90 contacts the inner round surface of the shoe 91, the rotation of the transmitter 89 is transmitted to the rotator 85. Thus the rotator 85 rotates with the transmitter 89 and the viscous resistance of the viscous agent V enclosed in the space between the rotator 85 and the casing 84 effects the transmitter and then effects the rotational pin 70 by way of the coil spring 86, the cam 88 and the joint 87. The viscous resistance at the rotational pin 70 is applied to the toilet lid 100 and effects a resistant force when the toilet lid is lowered.

On the other hand, the coil spring 86 is applied with a twisting force in the winding direction according to the rotation of the transmitter 89. The twisting force applied to the coil spring 86 effects a resistant force for the rotational pin 70 and eventually for the toilet lid 100.

Therefore, the toilet lid 100 pivots smoothly without a resistant force working in the ascending direction but is lowered slowly in the descending direction when the toilet lid 100 is released from a hand.

The following paragraphs describe the support receiving mechanism 120 built into the toilet lid 100.

As FIG. 3 shows, the support receiving mechanism 120 is formed in the same construction on each lateral side of the lid support base 102 of the toilet lid 100. The support receiving mechanism 120 comprises a tube-shaped support part 122. The tube-shaped support part 122 is formed in a diameter slightly larger than the longitudinal length of the cylindrical surface 65*a* of the slide support base 62 and is formed in a shape the section of which is a circle rotatably supported over the cylindrical surface 65*a*. At the lower end of the tube-shaped support part 122 in the figure, an opening 124 is formed as a cutaway slightly wider than the width of the support mechanism 50, that is the width between the two vertical surfaces 65*b*.

A fitting recess 132 is formed at approximately the center of the bottom surface of the support mechanism. The fitting recess 132 is formed in a narrow groove with an opening 136 at one end. The opening 136 is formed in the position above center of the opening 124.

Figure 5:
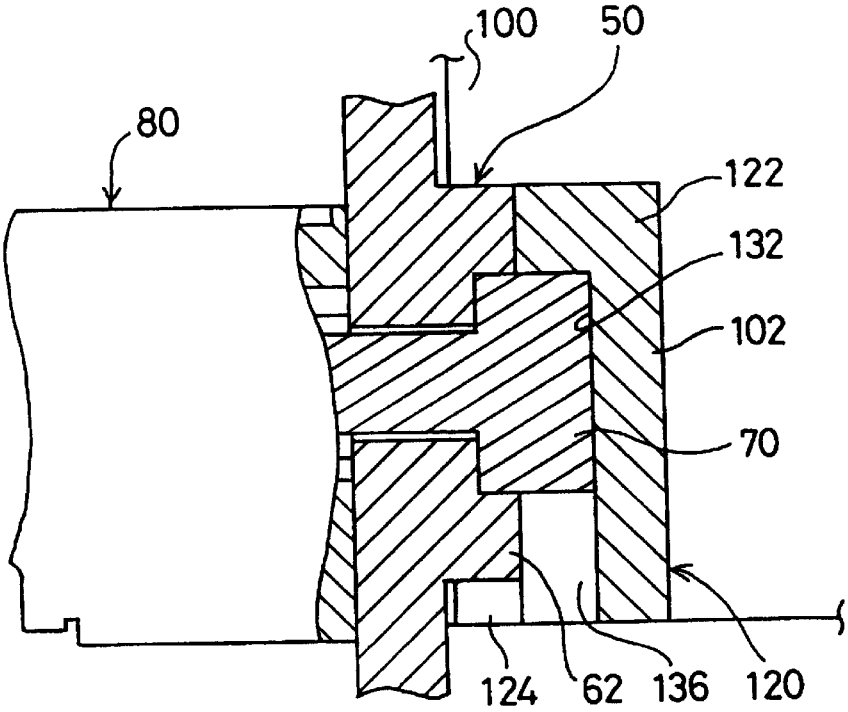
FIG. 5 is an illustrative drawing showing the state where the toilet lid in FIG. 4 is raised to the upright position.
Figure 6:
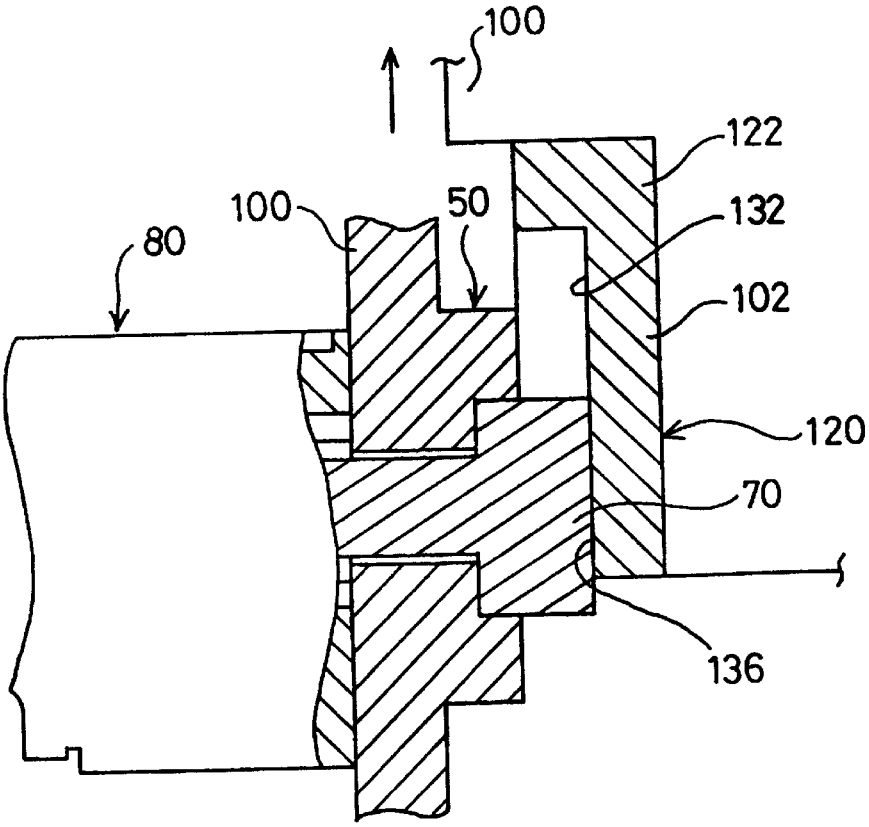
FIG. 6 is an illustrative drawing showing the state where the toilet lid in FIG. 5 is removed.
Figure 7:
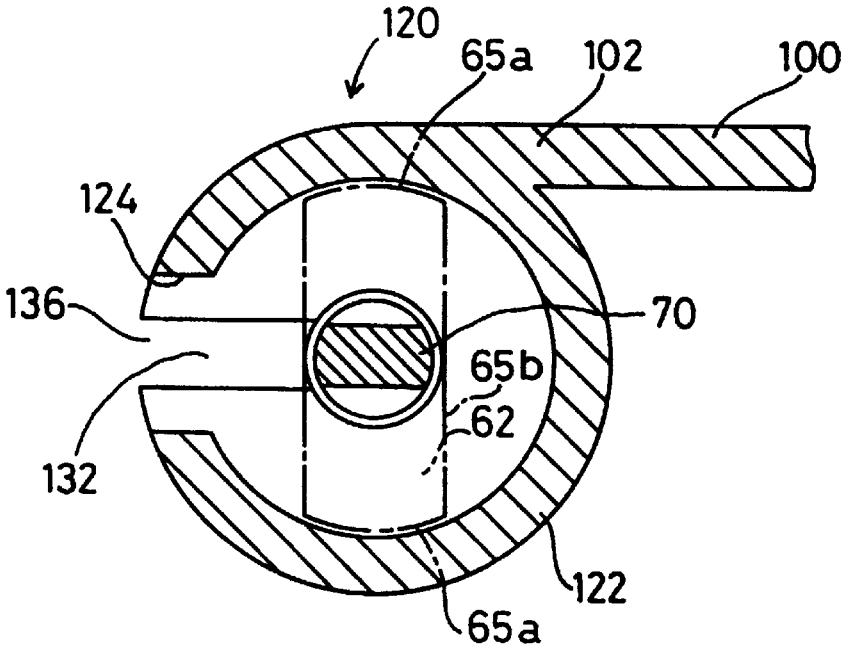
FIG. 7 is an illustrative drawing showing the state where the toilet lid is fully lowered as one action of the toilet lid support structure.
Figure 8:
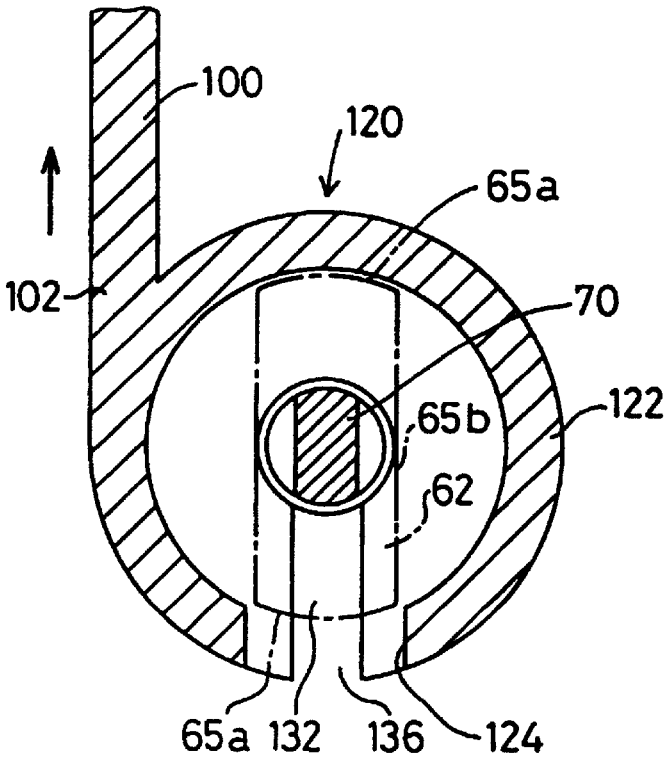
FIG. 8 is an illustrative drawing showing the state where the toilet lid is to be removed as one action of the toilet lid support structure.

The ascending and descending actions of the toilet lid 100 by the toilet lid support mechanism 30 are explained with use of FIGS. 5 to 8. FIG. 5 shows the state where the toilet lid 100 in FIG. 4 is raised and FIG. 6 shows the state where the toilet lid 100 is pulled upwards; FIG. 7 shows the state where the toilet lid 100 is fully lowered and FIG. 8 shows the state where the toilet lid 100 is raised upright.

In the state in FIG. 7, the tube-shaped support part 122 of the support receiving mechanism 120 is supported by the cylindrical surface 65*a* of the slide support base 62 and the fitting recess 132 fits the rotational pin 70; therefore, the tube-shaped support part 122 slides around the cylindrical surface 65*a* of the slide support base 62 following the pivotal action of the toilet lid 100 and the rotational pin 70 fitted to the fitting recess 132 simultaneously rotates on receiving the resistant force by the viscous resistance mechanism 80 in the lowering direction.

The toilet lid 100 is thus pivoted smoothly by a resistant force in the lowering direction effected by the rotation of the rotational pin 70 while being securely supported in the contact state by the tube-shaped support part 122 and the cylindrical surface 65*a*. That is, the toilet lid 100 is raised and lowered securely and smoothly by the two support structures in the toilet lid support mechanism.

To remove the toilet lid 100 from the casing main body 14, as shown in FIGS. 5 to 8, the toilet lid 100 is held by hand and raised upright and then pulled out in the direction of the arrow as in FIG. 6. That is, the tube-shaped support part 122 can be pulled out since the opening 124 is aligned with the position of the vertical surface 65*b* of the slide support base 62, and the rotational pin 70 can be pulled out anytime through the opening 136 since it is rotated while being fitted to the fitting recess 132. Therefore, the support receiving mechanism 120 is released from the main body support part 60 in the support state in the upright position of the toilet lid 100. That is, when the toilet lid 100 is raised to the upright position and pulled out in the prescribed direction, the toilet lid 100 is removed from the casing main body 14 easily. After the removal of the toilet lid 100 from the casing main body 14, cleaning operations can be easily carried out in all areas.

The structure is highly durable since the tube-shaped support part 122 and the other parts are not elastically deformed for attaching-detaching the toilet lid as by the conventional art.

The detachability of the toilet lid 100 from the casing main body 14 is not only convenient when cleaning the toilet lid 100, the casing main body 14 and the toilet bowl main body 202 but is also merited with the following effects. That is, the toilet lid 100 is linked with the viscous resistance mechanism 80 by way of the rotational pin 70 but trouble can be caused by an external force transmitted to the viscous resistance mechanism 80 when an impact is applied to the toilet lid 100 during conveyance. However, since engagement and disengagement is facilitated by the rotational pin 70 and the fitting recess 132, impact on the viscous resistant mechanism 80 is prevented by removal of the toilet lid 100 from the casing main body 14 during conveyance.

Besides the rotational pin 70 and the fitting recess 132 between the casing main body 14 and the toilet lid 100, support by the slide support base 62 and the tube-shaped support part 122 also prevents any twisting force and other external forces and an overload on the viscous resistance mechanism 80 which is linked to the rotational pin 70.

The present invention is not limited to the embodiment described above but it is possible for it to be embodied in various modes within its scope, including the following variations:

(1) The support structure for the casing main body 14 and the toilet lid 100 is explained as for the embodiment described above but, not limited to this, the structure described above may be applied to the toilet seat 16.

(2) The support mechanism 50 is located on the side of the casing main body 14 and the support receiving mechanism 120 is located on the side of the toilet lid 100 in the embodiment described above but, not limited to this, the locations may be vice versa.

The following paragraphs describe a support structure for the toilet seat and lid related to an alternative embodiment.

Figure 9:
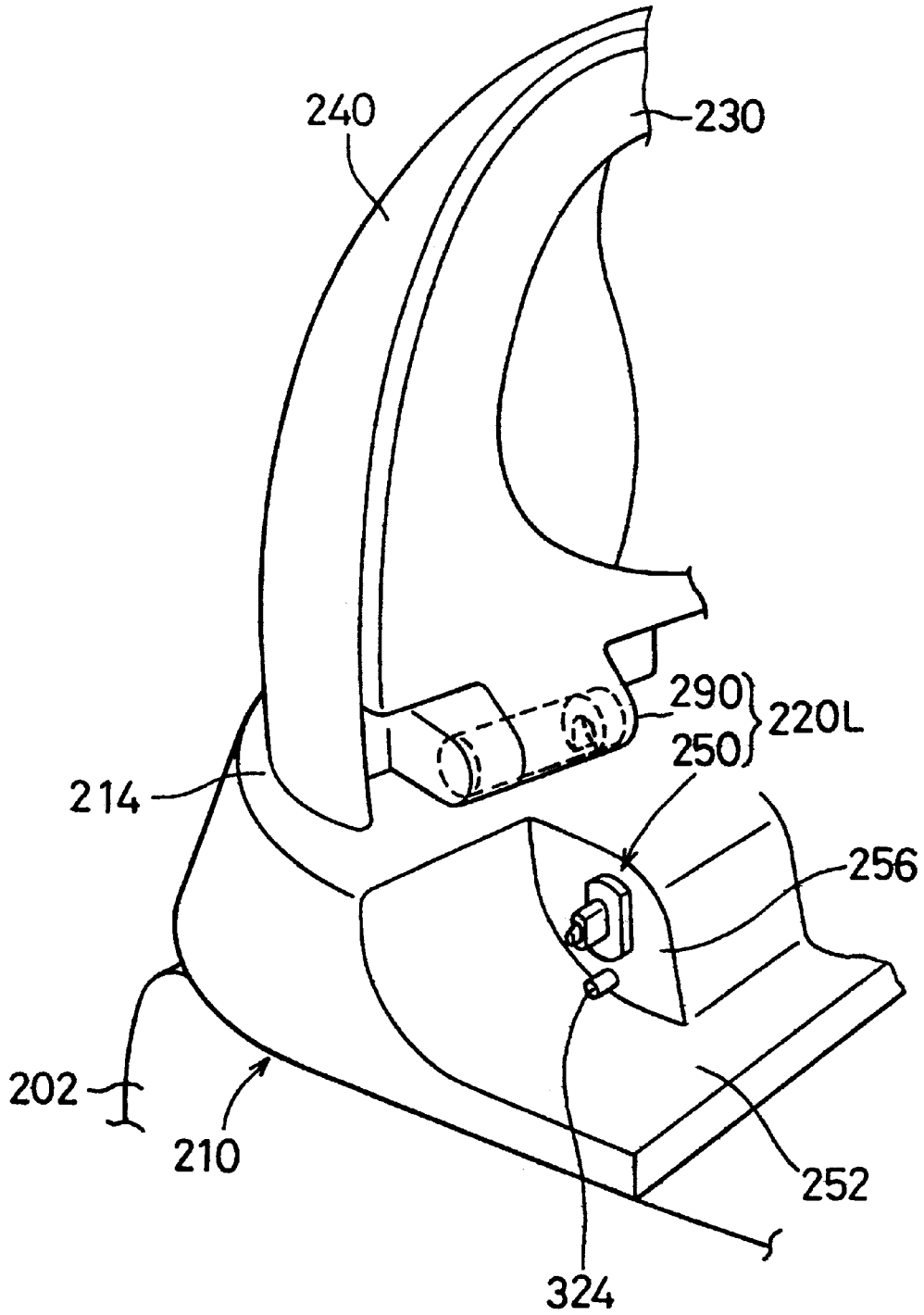
FIG. 9 is a perspective view drawing of a principal part of a sanitary washing unit which comprises a toilet seat/toilet lid support structure related to an alternative embodiment of the present invention.
Figure 10:
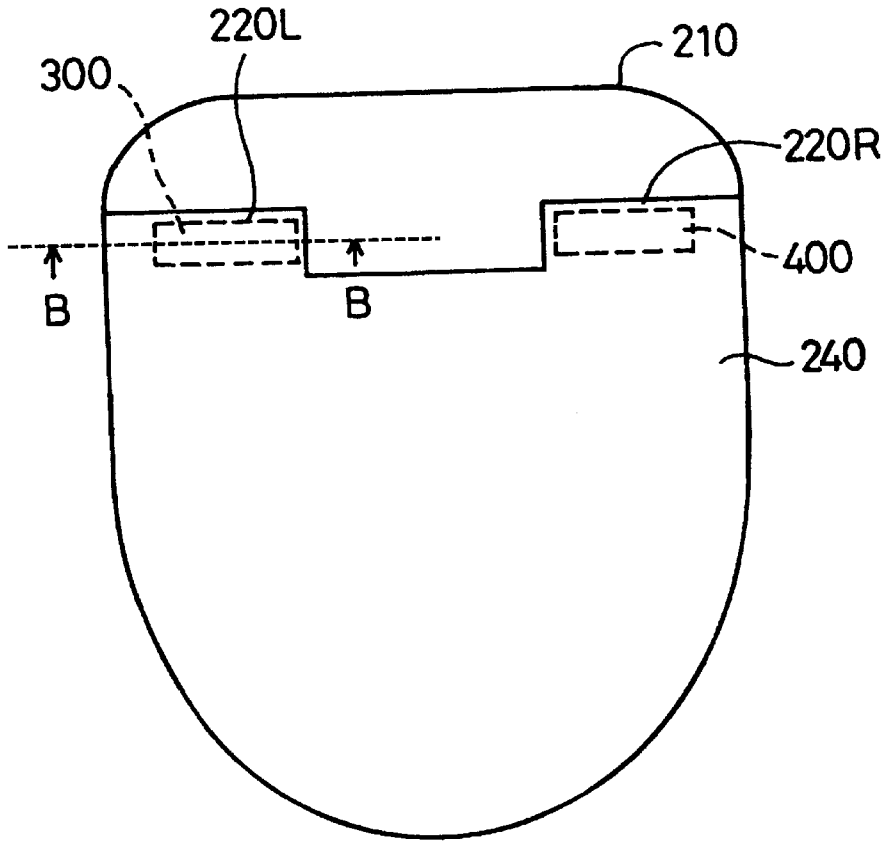
FIG. 10 is a plan of the sanitary washing unit.

FIG. 9 is a perspective view drawing of a part of a sanitary washing unit 210 mounted on a toilet bowl main body 202 which shows the state where a toilet seat 230 and a toilet lid 240 are removed. FIG. 10 is a plan of the sanitary washing unit 210.

Figure 11:
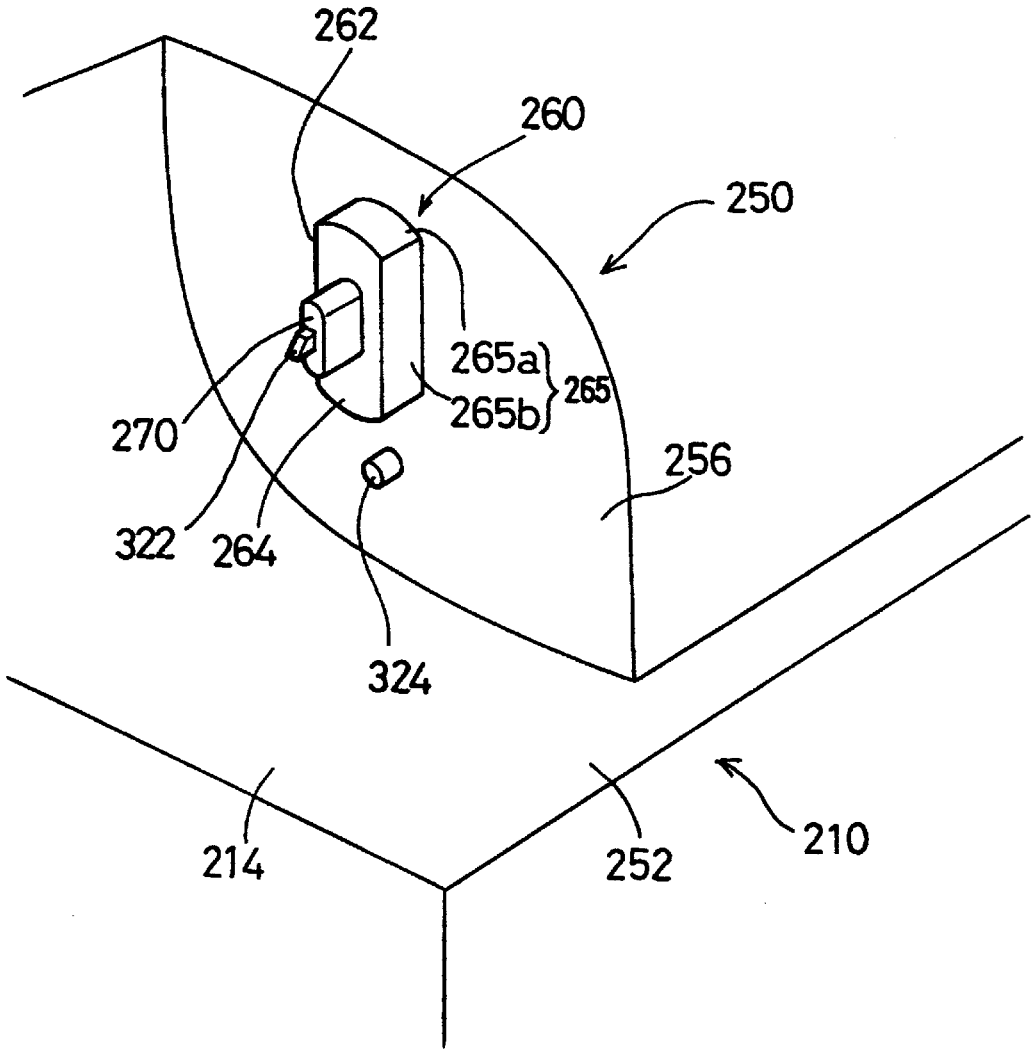
FIG. 11 is a perspective view drawing showing the support structure located on the side the casing main body.

The sanitary washing unit 210 comprises a casing main body 214, and the toilet seat 230 and the toilet lid 240 are pivotably and detachably attached to the casing main body 214 by way of hinge mechanisms 220R/L (the figure shows one of the pair) on the same shaft core. The hinge mechanism 220L is constructed with a support mechanism 250 on the side of the casing main body 214 and a support receiving mechanism 290 on the side of the toilet seat 230 and the toilet lid 240. The support mechanism 250 is located, as shown by magnification in FIG. 11, in a support recess 252 (the figure shows one of the pair) on either side of the casing main body 214, and is mainly constructed with a main body support part 260 which protrudes from a supporting wall 256 of a support recess 252 in the direction of the shaft core.

The main body support part 260 comprises a slide support base 262, and the slide support base 262 is formed of a facing surface 264 and outer surfaces 265. The outer surfaces 265 which are the top and bottom cylindrical surfaces 265*a* and both the vertical surfaces 265*b* form a shape which has a rectangular section with a round top and bottom. A fixed projection 270 protrudes from the facing surface 264. The fixed projection 270 is of a downsized shape of the slide support base 262. Another unit of the main body support part 260 is located on the supporting wall which corresponds to the support recess on the other side not shown in the figure but its description is eliminated since the structure is the same.

Figure 12:
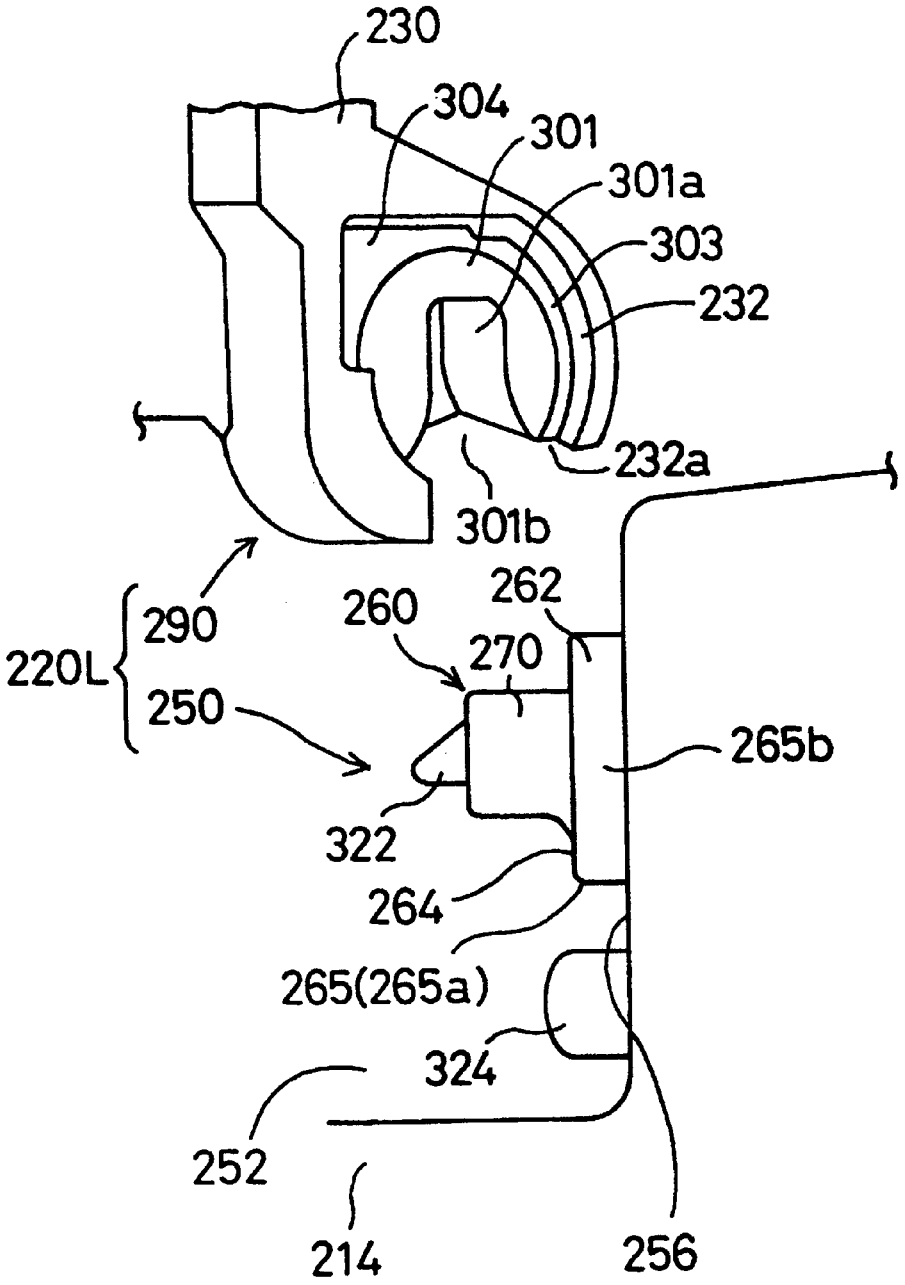
FIG. 12 is an illustrative drawing showing the state where the toilet seat and the toilet lid are removed.
Figure 13:
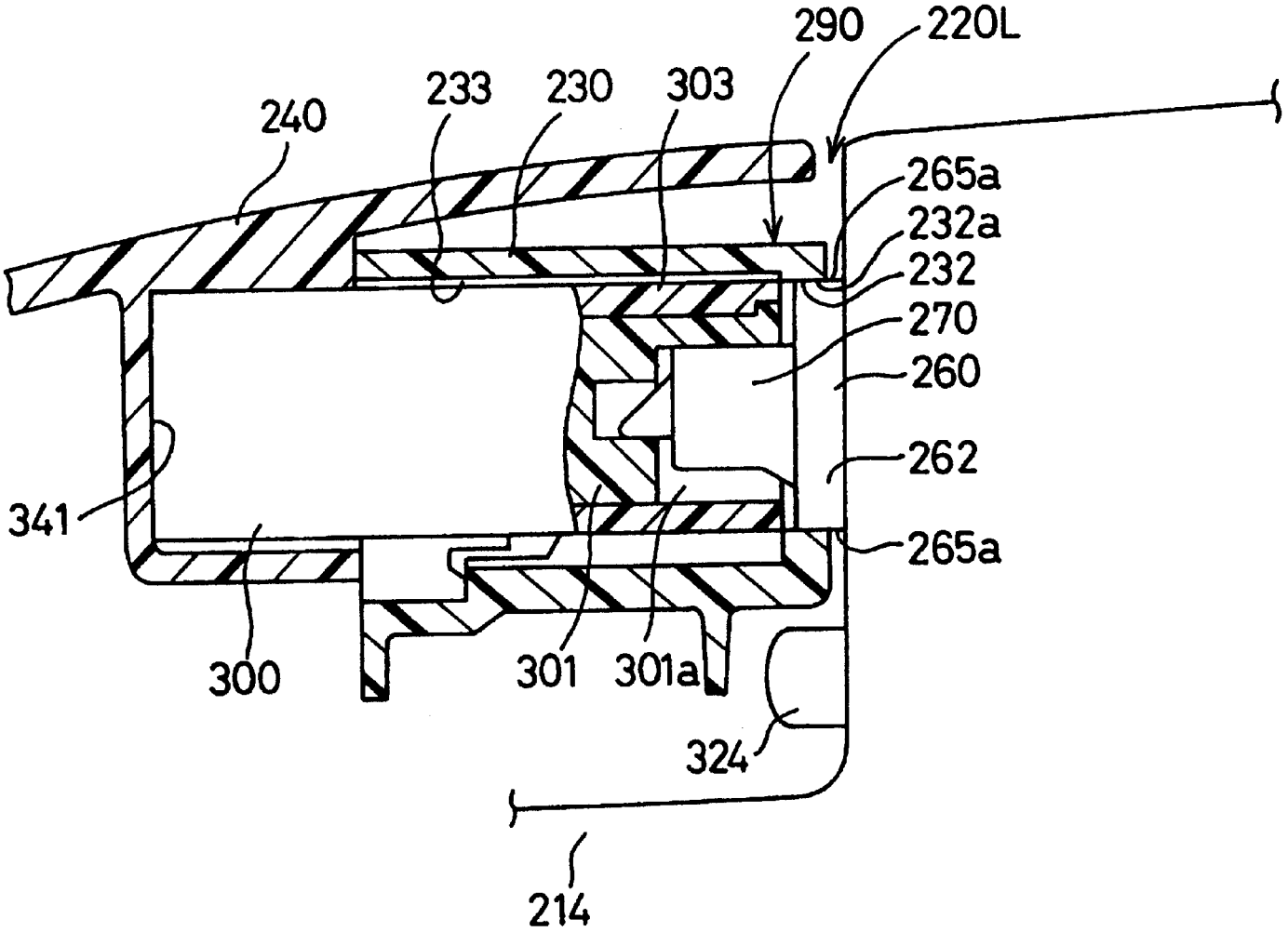
FIG. 13 is a sectional drawing showing a principal part along the line B—B in FIG. 10.

A support receiving mechanism 290 on the side of the toilet seat 230 and the toilet lid 240 is described below. FIG. 12 is an external view drawing showing a part of the hinge mechanism 220L with the toilet seat 230 and the toilet lid 240 removed; FIG. 13 is a drawing along the line B—B in FIG. 10 with some parts cut out; and FIG. 14 is a drawing showing the state where the toilet seat 230 and the toilet lid 240 in FIG. 13 are raised to the upright position.

Each of the support receiving mechanisms 290 is located on either side of the end part of the toilet seat 230 and the toilet lid 240 and comprises a round support part 232 formed at either end part of the toilet seat 230. The round support part 232 is formed in a shape, a section of which is round and the diameter of which is slightly larger than the longitudinal length of the cylindrical surface 265*a* of the slide support base 262, and is rotatably supported by the top and bottom cylindrical surface 265*a*. A part of the round support part 232 is cut away to form an opening 232*a*.

Figure 14:
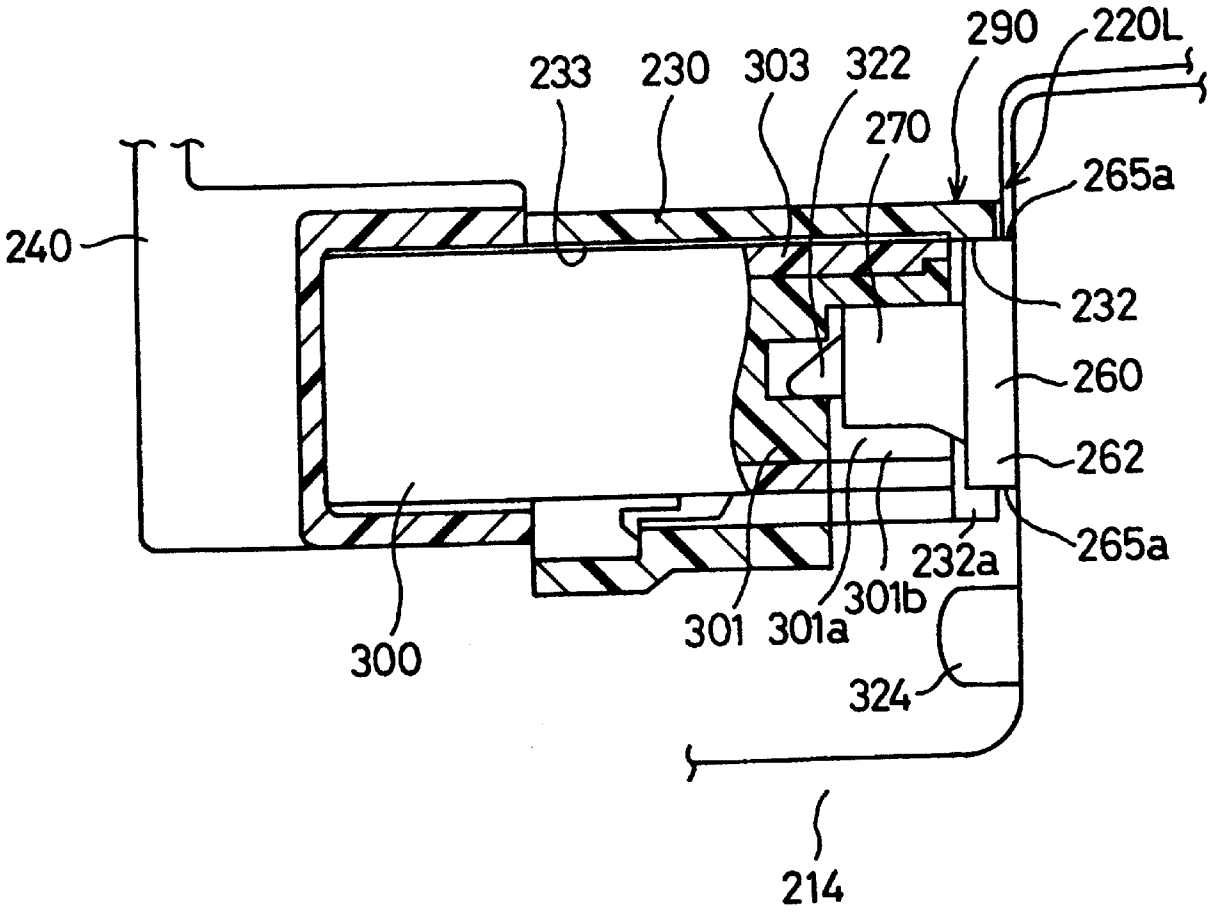
FIG. 14 is a sectional drawing showing the state where the toilet seat and the toilet lid in FIG. 13 are raised to the upright position.
Figure 15:
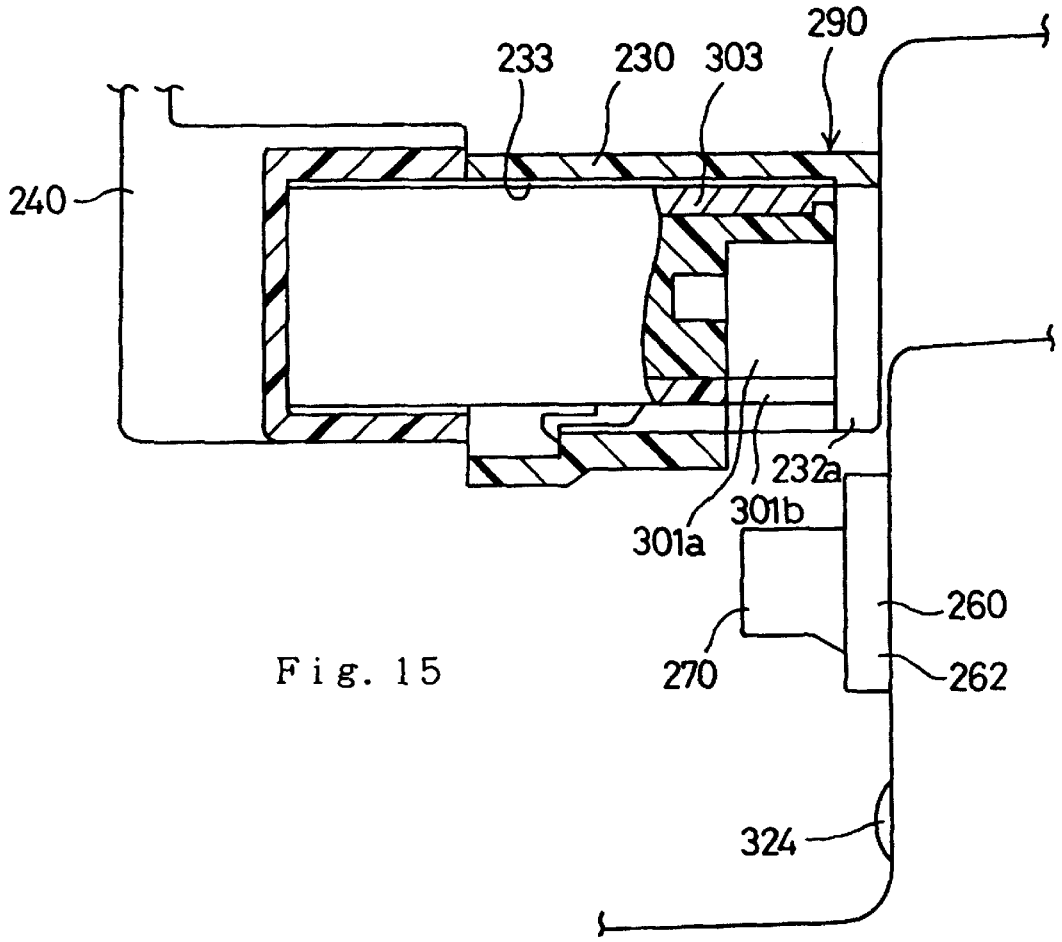
FIG. 15 is a sectional drawing showing the state where the toilet seat and the toilet lid in FIG. 14 are removed.

As FIGS. 13 and 14 show, a seat-side storage space 233 is formed so as to continue to the round support part 232 of the toilet seat 230. A first viscous resistance mechanism 300 is stored in the seat-side storage space 233. The first viscous resistance mechanism 300 comprises a support base 301 that has a fitting recess 301*a* to which the fixed projection 270 is fitted. The fitting recess 301*a* is formed as a narrow groove with an opening 301*b* at one end. The opening 301*b* is formed in a position to align with the center part of the opening 232*a*. The fitting recess 301*a* is constructed so that the fixed projection 270 is detachably attached through the opening 301*b*.

Figure 16:
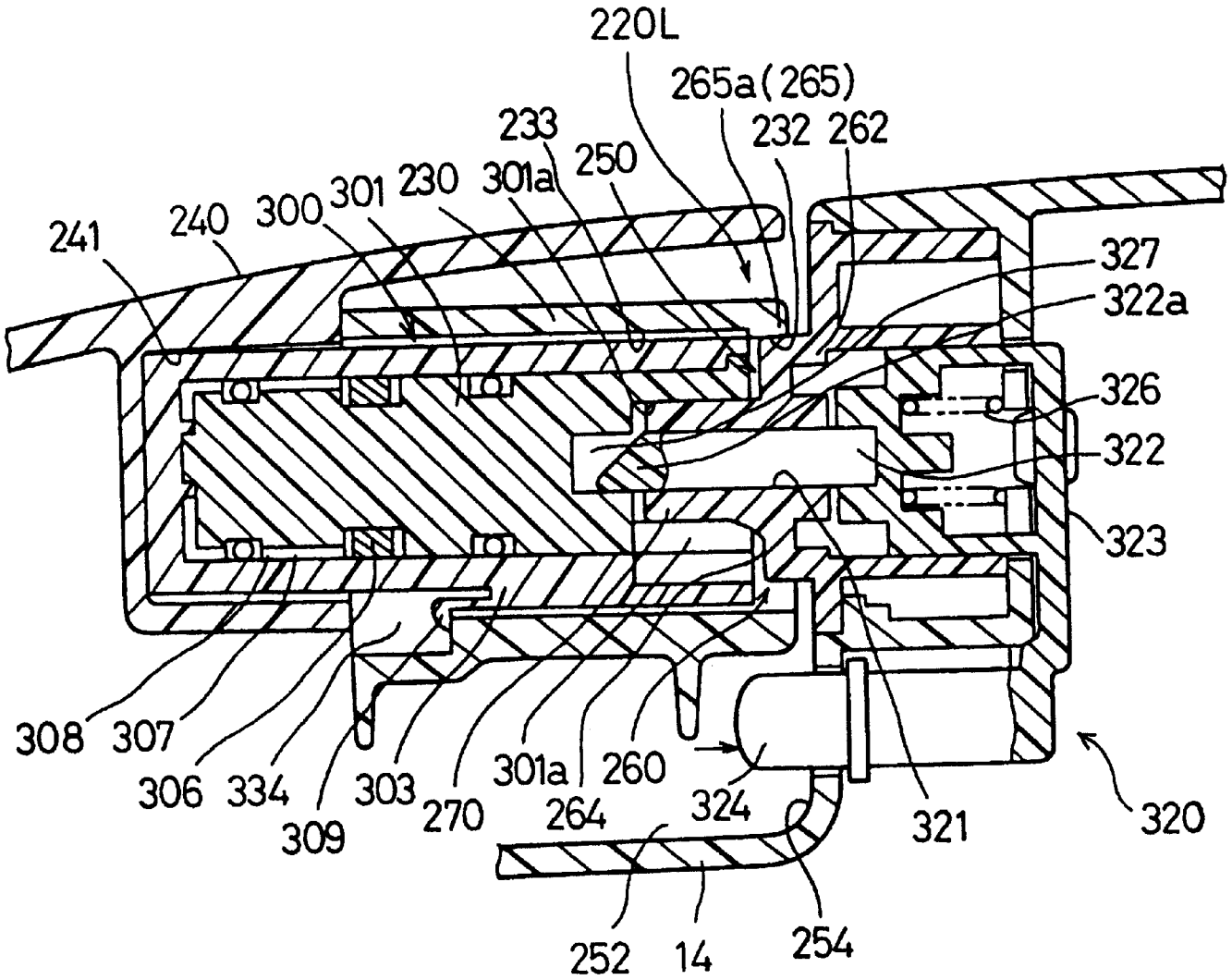
FIG. 16 is a sectional drawing along the line B—B in FIG. 10.

As FIG. 16 shows, the first viscous resistance mechanism 300 comprises an outer cylindrical viscous case 303 which is rotatably inserted over the support base 301, a viscous resistance space 307 which is formed between the support base 301 and the outer cylindrical viscous case 303 and partitioned by a one-way valve 306, a viscous material 308 which is filled in the viscous resistance space 307, and a linkage device 309 which engages the outer cylindrical viscous case 303 with the inner wall of the seat-side storage space 233 of the toilet seat 230. The linkage device 309 utilizes a snap-fit structure, and the engagement with the element on the side of the toilet seat 230 is released by elastic deformation when a flat-end screw driver or similar tool is inserted through a through-hole 334 which runs through the seat-side storage space 233. This allows the first viscous resistance mechanism 300 to be pulled out of the seat-side storage space 233.

As FIG. 12 shows, the outer cylindrical viscous case 303 is joined so as to rotate with the toilet seat 230 as a single unit by a key joint part 304 which is formed as a projection from the outer cylindrical viscous case 303. The structure of the first viscous resistance mechanism 300 allows the outer cylindrical viscous case 303 to rotate around the support base 301 when the toilet seat 230 is raised or lowered, and thus the toilet seat 230 pivots slowly at this point with the viscous-resistant force of the viscous material 308.

Besides this, as FIG. 13 shows, a bottom-located hole 341 of the toilet lid 240 is pivotably supported by the outer cylindrical viscous case 303 of the first viscous resistance mechanism 300. Therefore, the toilet lid 240 pivots with the outer cylindrical viscous case 303 as its axis but without receiving the viscous-resistant force from the first viscous resistance mechanism 300 since the outer cylindrical viscous case 303 and the bottom-located hole 341 are not linked.

Figure 20:
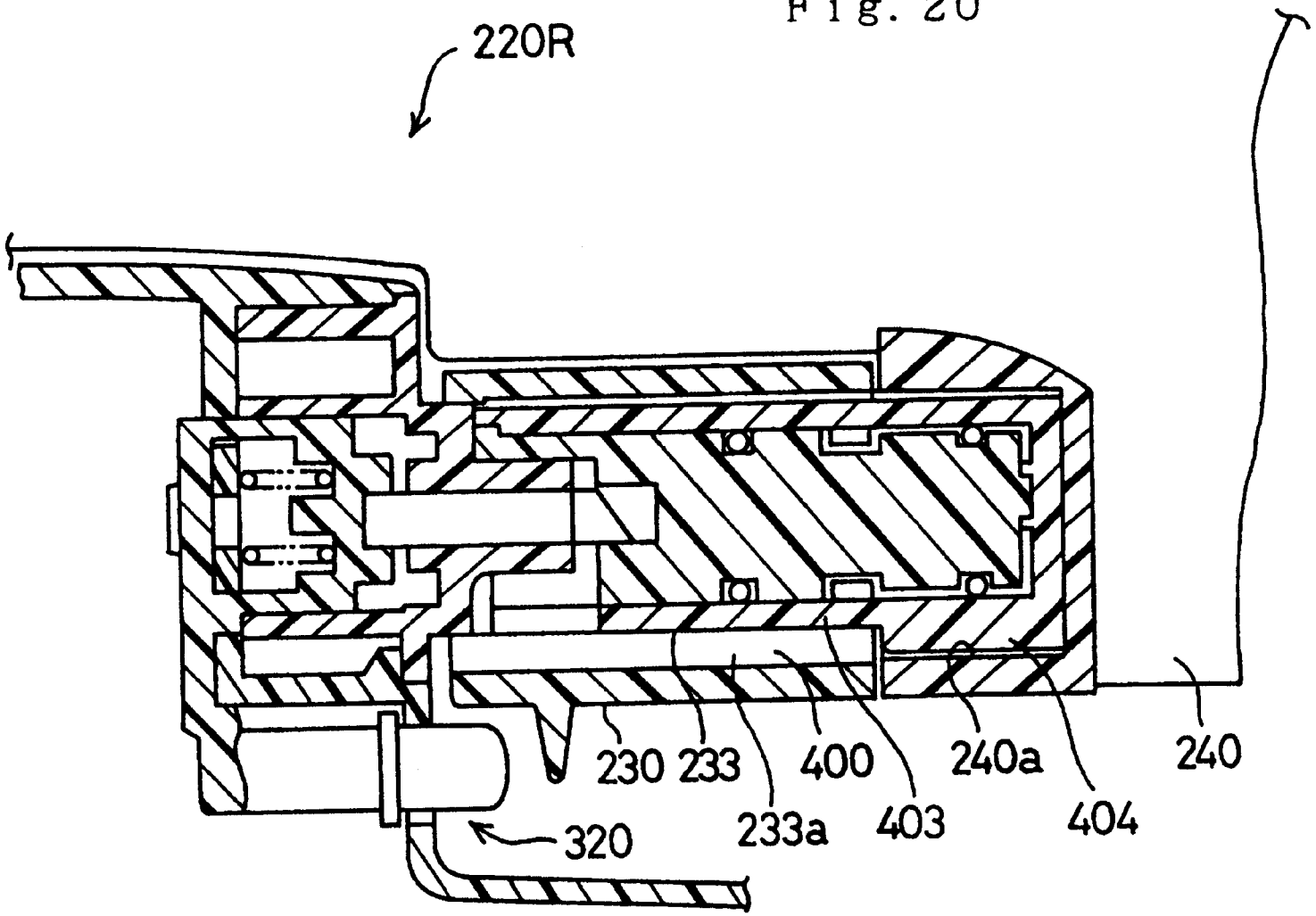
FIG. 20 is a sectional view of a hinge mechanism in an alternative location which links the toilet lid and the toilet seat so as to be pivoted freely.

As FIG. 20 shows, a second viscous resistance mechanism 400, which is a part of the other hinge mechanism 220R, is located between the toilet seat 230 and the toilet lid 240 almost in the same configuration as the first viscous resistance mechanism 300 but the configuration is different from the first viscous resistance mechanism 300 in the following. That is, the second viscous resistance mechanism 400 is constructed so that a key joint part 404 which is formed as a projection from an outer cylindrical viscous case 403 will engage a recess 240*a* on the side of the toilet lid 240. The outer cylindrical viscous case 403 runs through the seat-side storage space 233 of the toilet seat 230 and is not linked to the toilet seat 230 by such a linkage device as by the snap-fit structure. Therefore, pivotal movement of the toilet seat 230 will not rotate the outer cylindrical viscous case 403 but the pivotal movement of the toilet lid 240 will rotates the outer-cylindrical viscous case 403 and then the viscous-resistant force of the viscous material will effect the toilet lid 240. Thus the toilet lid 240 alone can be pivoted slowly in the descending direction even when the toilet seat 230 is fully lowered.

The second viscous resistance mechanism 400 is also constructed so as to be removed separately from the toilet seat 230 or other units. That is, after the toilet seat 230 and the toilet lid 240 are removed from the casing main body 214 as described below, the second viscous resistance mechanism 400 can be pulled out without being hindered by the key joint part 404, as FIG. 20 shows, since the key joint part 404 aligns with a key release recess 233*a* of the seat-side storage space 233 in the state where the toilet seat 230 and the toilet lid 240 are opened apart to a right angled position. When the toilet seat 230 and the toilet lid 240 are fully closed together, the second viscous resistance mechanism 400 cannot be pulled out with the key joint part 404 touching the side of the toilet lid 240 since the key joint part 404 does not align with the key release recess 233*a* of the seat-side storage space 233. Therefore, as described below, the second viscous resistance mechanism 400 cannot be pulled out by mistake when both the toilet seat 230 and the toilet lid 240 are in the state where they are removed while being raised to the upright position; and besides this, it cannot be pulled out without opening apart the toilet seat 230 and the toilet lid 240 to the right angled position.

Figure 17:
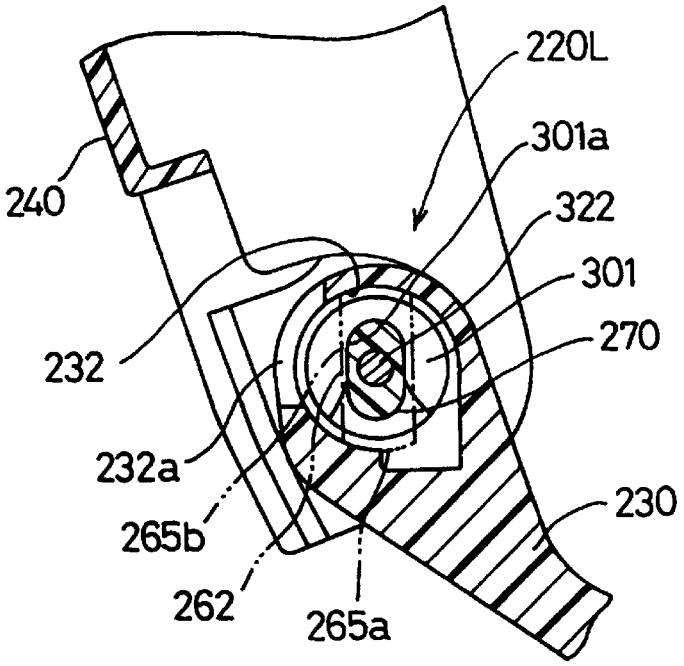
FIG. 17 is an illustrative drawing showing the state where the toilet seat is fully lowered and the toilet lid is raised to the upright position as one action of the toilet seat/toilet lid support structure.
Figure 18:
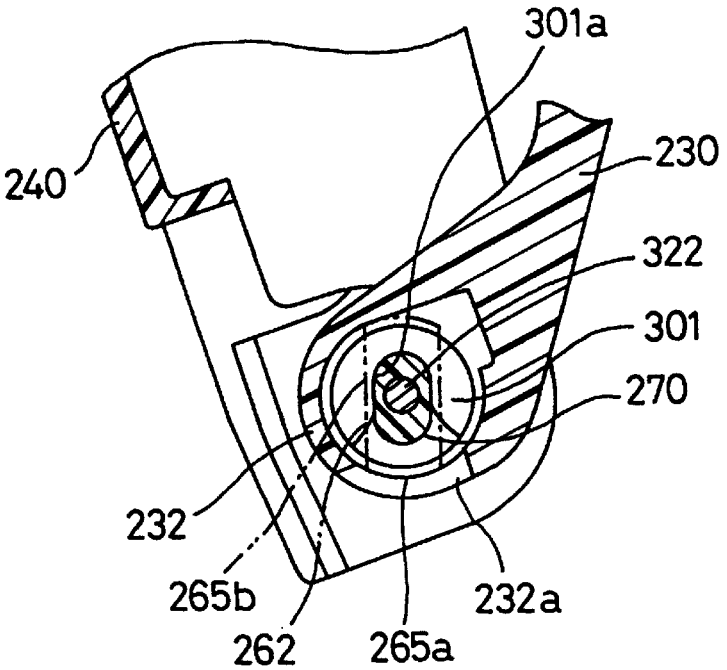
FIG. 18 is an illustrative drawing showing the state where the toilet seat and the toilet lid are raised to the upright position as the next action of FIG. 17.
Figure 19:
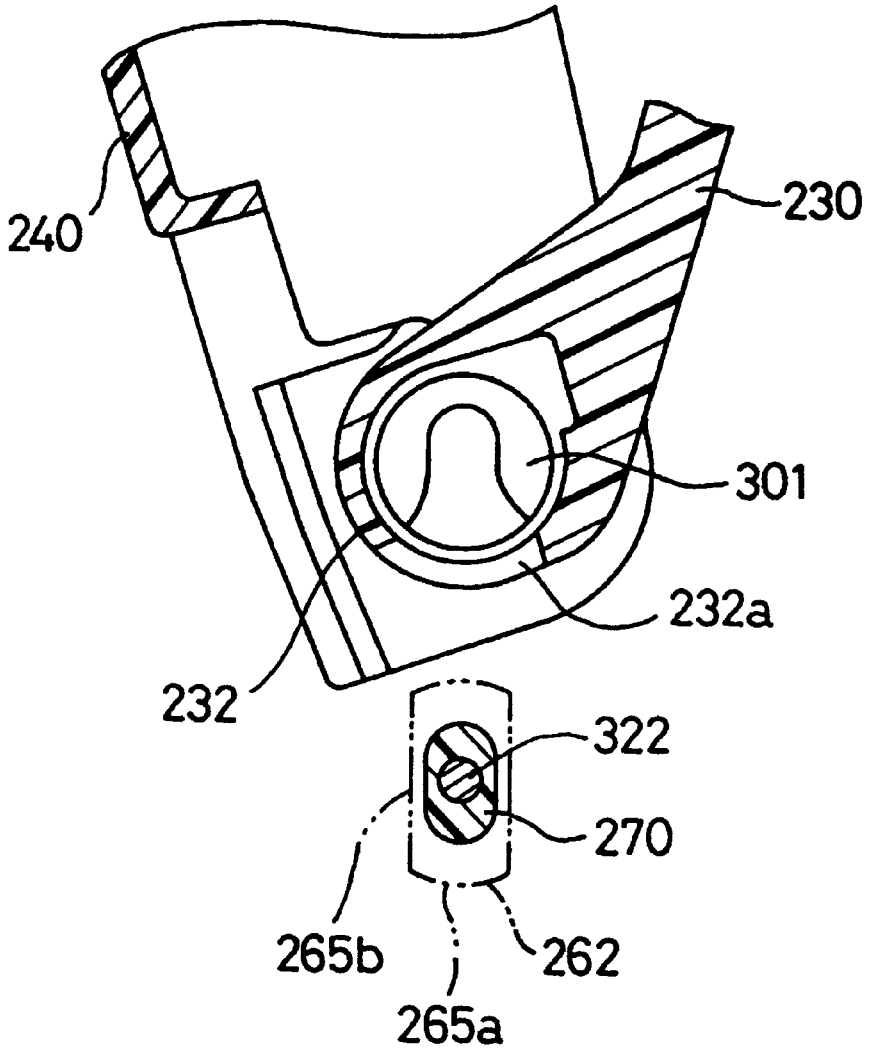
FIG. 19 is an illustrative drawing showing the state where the toilet seat and the toilet lid are removed after the state in FIG. 18.

With reference to FIGS. 17 and 18, the raising and lowering operations of the toilet seat 230 and the toilet lid 240 by way of the hinge mechanism 220L are described below: FIG. 17 shows the state where the toilet seat 230 is fully lowered with the toilet lid 240 being raised to the upright position and FIG. 18 shows the state where the toilet seat 230 and the toilet lid 240 are raised almost to the upright position.

In the state shown in FIG. 17, the round support part 232 of the toilet seat 230 is supported on the cylindrical surface 265*a* of the slide support base 262 and the fixed projection 270 fits in the fitting recess 301*a;* therefore the round support part 232 slides over the cylindrical surface 265*a* of the slide support base 262 following the raising and lowering operations of the toilet seat 230 and simultaneously the outer cylindrical viscous case 303 of the first viscous resistance mechanism 300 which is unified with the toilet seat 230 rotates while having a viscous-resistant force on the support base 301.

Therefore, the toilet seat 230 is raised and lowered smoothly with the viscous-resistant force of the first viscous resistance mechanism 300 while being supported by the fixed projection 270 and the fitting recess 301*a* of the support base 301 and being also securely supported in the contact state by the round support part 232 and the cylindrical surface 265*a* of the slide support base 262. That is, the toilet seat 230 is raised and lowered smoothly without rattling against the slide support base 262 of the casing main body 214 by the two support structures in the hinge mechanisms 220L and 220R.

As FIG. 16 shows, the hinge mechanism 220L is equipped with a lock mechanism 320 for locking and unlocking the toilet seat 230 and the toilet lid 240 securely to and from the casing main body 214. The lock mechanism 320 comprises a lock engagement element 322 which is fitted by insertion into the fitting insertion hole 321 which is formed in the slide support base 262, a holder component 323 which holds the lock engagement element 322, an unlock button 324 which is located in linkage with the holder component 323, and a spring 326 which is supported by the casing main body 214 at one end and applying energy in contact with the holder component 323 at the other end. The tip 322*a* of the lock engagement element 322 is thrust into the engagement recess 327 formed in the support base 301 of the first viscous resistance mechanism 300 so that it can advance and retract.

When the unlock button 324 is pressed in the direction of the arrow in this configuration of the lock mechanism 320, the holder component 323 moves together with the unlock button 324 as a single body against the applied energy in the spring 326. The lock engagement element 322 secured to the holder component 323 retracts by this operation and becomes disengaged from the engagement recess 327 in the support base 301. When the unlock button 324 is released, the tip 322*a* of the lock engagement element 322 is thrust into the engagement recess 327 by the applied energy of the spring 326 to prevent the toilet seat 230 from coming out of the casing main body 214.

To remove the toilet seat 230 and the toilet lid 240 from the casing main body 214 by way of the hinge mechanism 220L, as FIGS. 14 to 18 show the unlock button 324 is pressed while the toilet seat 230 and the toilet lid 240 are held by hand and raised to the upright position. That is, the toilet seat 230 can be pulled out through the opening 232*a* which is aligned with the width between the vertical surfaces 265*b* of the slide support base 262 when in the upright position and the fixed projection 270 can be pulled out any time through the opening 301*b* in the fitting recess 301*a*. That is, when the toilet seat 230 and the toilet lid 240 are in the upright position, the toilet seat 230 is in the state where support for the main body support part 260 can be released. Besides this, when the unlock button 324 is pressed, the tip 322*a* of the lock engagement element 322 comes out of the fitting recess 301*a* against the spring force by way of the holder component 323.

As in FIGS. 15 to 19, if the toilet seat 230 and the toilet lid 240 are pulled out in this state the toilet seat 230 and the toilet lid 240 are easily removed from the casing main body 214. The toilet seat 230 and the toilet lid 240 removed from the casing main body 214 are easily cleaned in all areas To attach the toilet seat 230 and the toilet lid 240 to the casing main body 214, the toilet seat 230 and the toilet lid 240 are held in the same upright position as the state for removal and brought down while the opening 232*a* of the round support part 232 is aligned with the slide support base 262. Through this operation, the lock engagement element 322 is pressed by the end part of the support base 301, pushed inward against the applied energy of the spring 326 and then supported in the former state as in FIG. 14. Therefore, the operation of the unlock button 324 of the lock mechanism 320 is not needed for the attaching of the toilet seat 230 and the toilet lid 240.

The embodiment described above allows the toilet seat 230 and the toilet lid 240 to be supported pivotably by the casing main body 214 by way of the hinge mechanism 220L and removal from the casing main body 214 is prevented if the unlock button 324 of the lock mechanism 320 is not operated. Thus the toilet seat 230 and the toilet lid 240 will not become disconnected unintentionally by an external force at the time of normal usage but the toilet seat 230 and the toilet lid 240 are quickly removed by a simple operation of pressing the unlock button 324 when required.

The durability is excellent because no elastic deformation of the opening 528 or other parts is required for attaching and detaching the toilet seat 230 and the toilet lid 240 as the conventional art.

This detachability of the toilet seat 230 and the toilet lid 240 from the casing main body 214 is convenient for the cleaning of the toilet seat 230, the toilet lid 240 and the toilet bowl main body 202 and is effective in the following way. That is, the toilet seat 230 and the toilet lid 240 are linked to the first viscous resistance mechanism 300, and trouble can be caused by an external force transmitted to the first viscous resistance mechanism 300 when an impact is applied to the toilet seat 230 and the toilet lid 240 during conveyance or on other occasions. As a resolution to such a problem, the removal of the toilet seat 230 and the toilet lid 240 from the casing main body 214 can prevent impact on the first viscous resistance mechanism 300 during conveyance.

The unlock button 324 of the lock mechanism 320 is located under the slide support base 262 and can be reached from the outside for manual operation when the toilet seat 230 and the toilet lid 240 are raised to the upright position but is hidden behind the toilet seat 230 and the toilet lid 240 when the toilet seat 230 and the toilet lid 240 are lowered to cover the toilet bowl main body 202. Therefore, the unlock button 324 cannot be operated by mistake when the toilet seat 230 and the toilet lid 240 are not raised upright, and the toilet seat 230 and the toilet lid 240 will not come out of the casing main body 214 even if an external force is applied.

Moreover, the position where the toilet seat 230 and the toilet lid 240 can be removed from the casing main body 214 is approximately 90 degrees where the toilet seat 230 and the toilet lid 240 are raised upright to the toilet bowl main body 202; therefore, the toilet seat 230 and the toilet lid 240 are not disengaged from the casing main body 214 since the large external force of a person is difficult to be applied.

The toilet seat 230 and the toilet lid 240 which are linked to each other and pivotably supported with the first and the second viscous resistance mechanisms 300 and 400 as the axes can be attached to and removed from the casing main body 214 simultaneously only, and the toilet lid 240, which is linked with the toilet seat 230, cannot be easily disconnected by an external force when a person is seated on the toilet seat 230.

The resistant forces of the first and the second viscous resistance mechanisms 300 and 400 should be set so that the pivotal speed of the toilet lid 240 which is generated by the resistant force of the second viscous resistance mechanism 400 is slower than the pivotal speed of the toilet seat 230 which is generated by the resistant force of the first viscous resistance mechanism 300. Since this setting prevents the force of the toilet lid 240 in the descending direction from being applied to the toilet seat 230 when the toilet seat 230 and the toilet lid 240 are simultaneously pivoted in the lowering direction, the first viscous resistance mechanism 300 receives no overload.

The present invention is not limited to the embodiment described above but it is also possible for it to be embodied in various modes within its scope, including the following variations (1) The support mechanism 250 is located on the side of the casing main body 214 and the support receiving mechanism 290 is located on the side of the toilet seat 230 and the toilet lid 240 in the embodiment described above but, not limited to this, the locations may be vice versa.

(2) The lock engagement element 322 is constructed as a part separate from the fixed projection 270, but it may be unified with the fixed projection as a single body so that the operation of the unlock button 324 allows the whole fixed projection 270 is to be movable over the slide support base 262.

Figure 21:
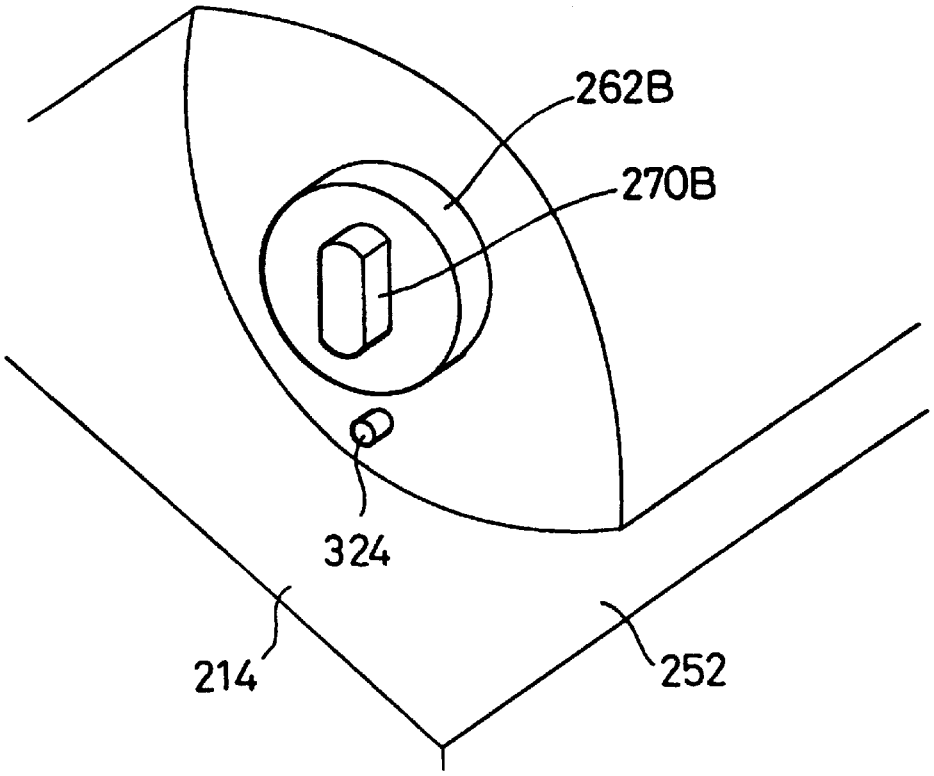
FIG. 21 is a perspective view drawing showing the support structure located on the side a casing main body related to another alternative embodiment.
Figure 22:
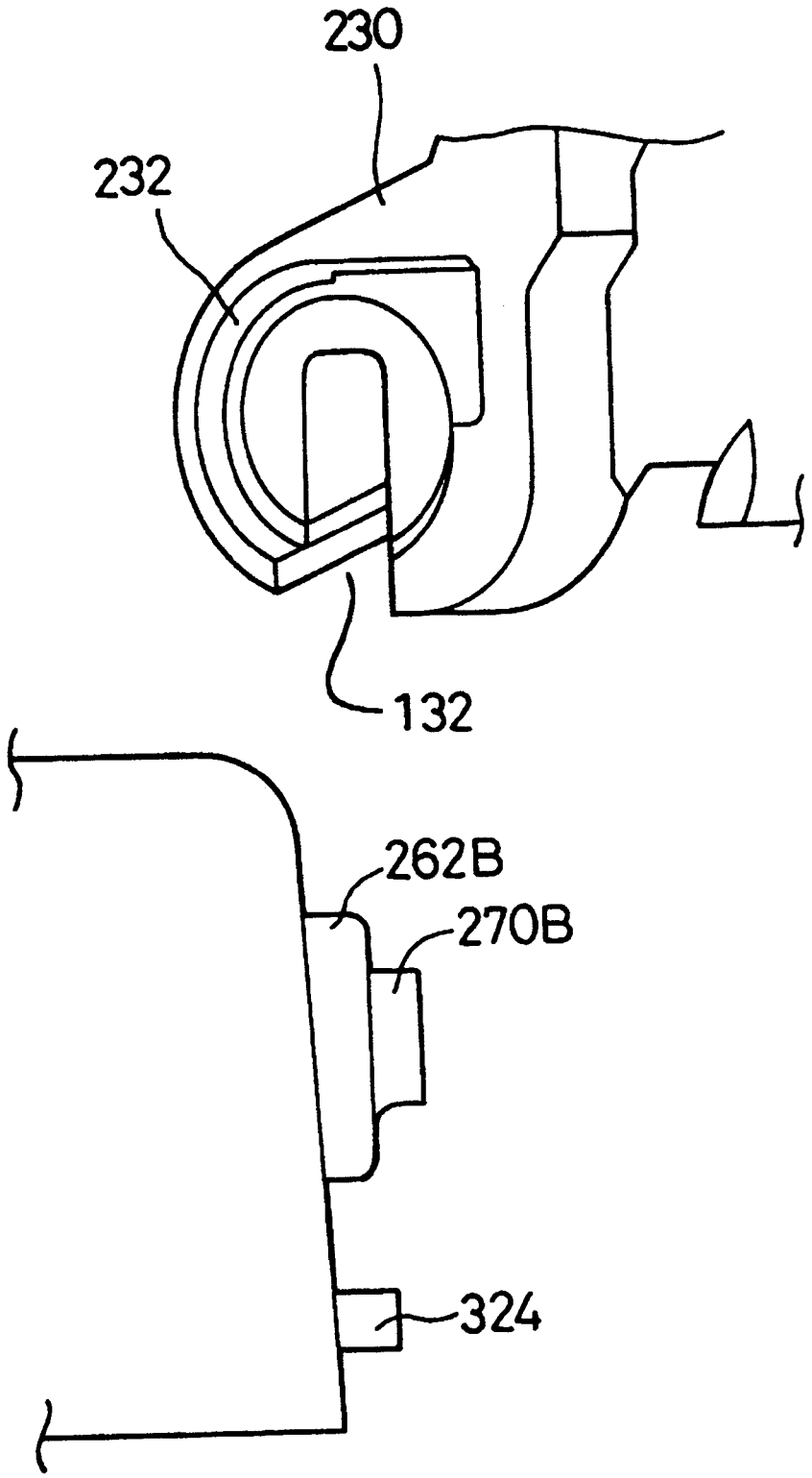
FIG. 22 is an illustrative drawing showing the state where the toilet seat and other units related to the alternative embodiment are removed.
Figure 23:
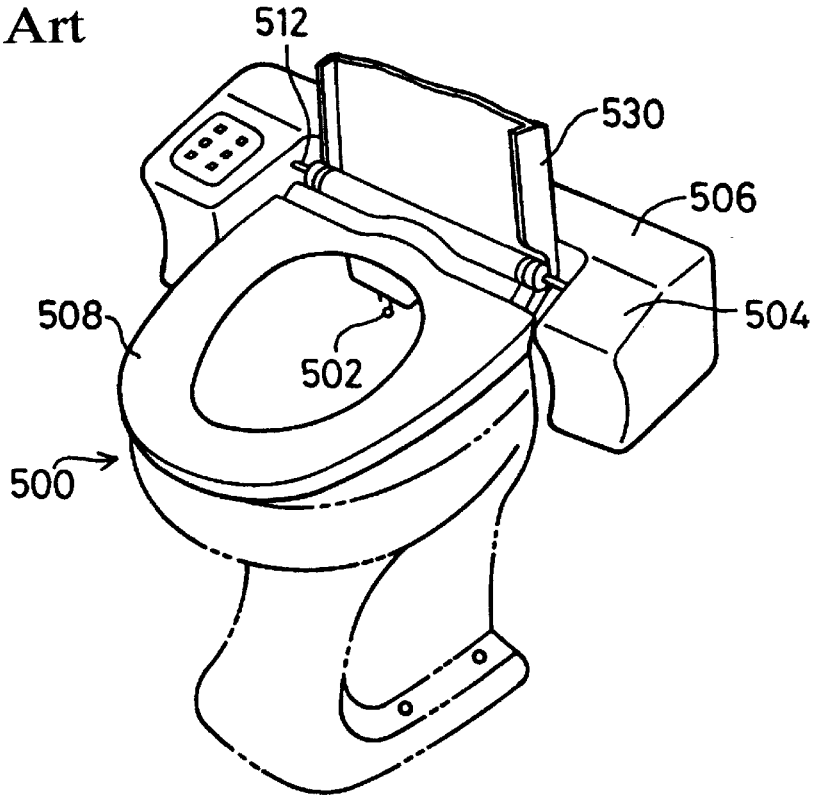
Fig. 23 Prior Art
FIG. 23 is an external view drawing showing a conventional western-style toilet bowl.
Figure 24:
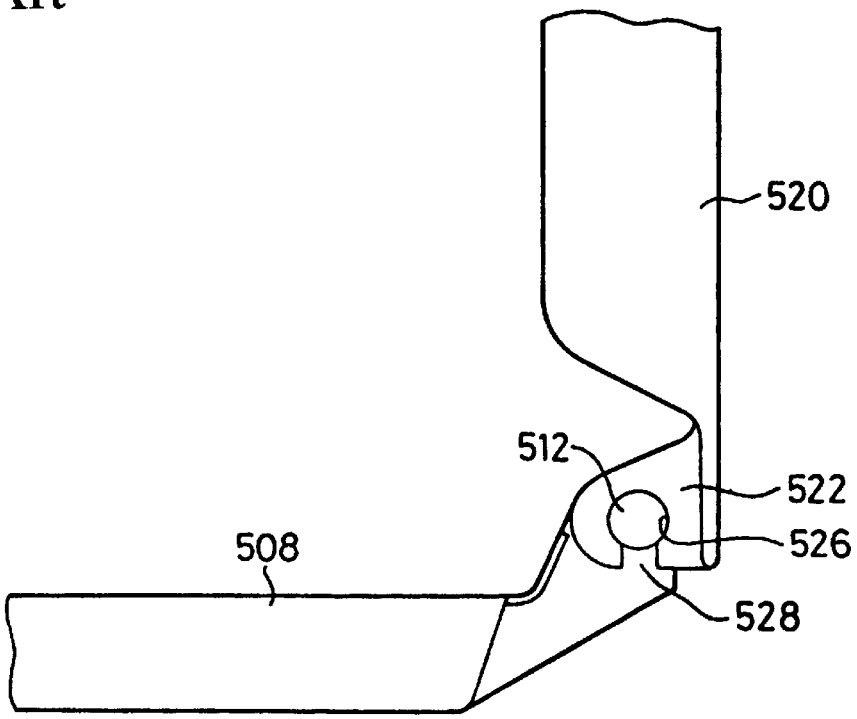
Fig. 24 Prior Art
FIG. 24 is an illustrative drawing showing a conventional toilet lid support structure.

(3) Moreover, the lock engagement element 322 is advanced and retracted to engage with and disengage from the side of the toilet seat 230, but not limited to this but, as FIGS. 21 and 22 show, a slide support base 262B and a fixed projection 270B as a whole or the slide support base 262B alone may be interlocked with the unlock button 324 to engage with and disengage from the side of the toilet seat 230 so that the pivotal support and locking of the toilet seat 230 are carried out simultaneously.

What is claimed is:

1. A support structure for a toilet cover unit, said support structure is secured to a casing main body that is, in turn, secured to a toilet bowl main body, comprising:

a pivotal support component (70) located at a first end part of said casing main body;

a rotational-force resistance means (86) which applies, in linkage with said pivotal support component, a resistant force to a pivotal movement in a lowering direction of said toilet cover unit, a support receiving part (132) coupled to said toilet cover unit, which engages with said pivotal support component so as to apply said resistant force to said toilet cover unit, said support receiving part being capable of being engaged with and disengaged from said pivotal support component when said toilet cover unit is positioned at a prescribed angle relative to said toilet bowl main body; and a hinge arrangement (65,120) which pivotably connects said toilet cover unit to said casing main body, said hinge arrangement being constructed so that said toilet cover unit can be attached to and detached from said main body at said prescribed angle, said hinge arrangement comprising a support component (65) and a supporting tube part (122), wherein said supporting tube part is supported by and capable of sliding over rounded surfaces of said support component, and where a cutaway part (124) is formed in a part of said supporting tube part through which said toilet cover unit is detachable from said support component when said toilet cover unit is positioned at said prescribed angle.

2. A support structure for a toilet cover unit claimed in claim 1, which comprises a lock mechanism which has a lock engagement part, which prevents said toilet cover unit from being detached from said support main body, while located between said toilet cover unit and said support main body, and a lock operation part, which releases said lock engagement part from said engaged state.

3. A support structure for a toilet cover unit claimed in claim 2, in which said lock operation part is located at a place at which manual operation is possible from said outside when said toilet cover unit is positioned at said prescribed angle and which is hidden behind said toilet cover unit when said toilet cover unit is not positioned at said prescribed angle.

4. A support structure for a toilet cover unit claimed in claim 3, in which said prescribed angle is approximately 90 degrees.

5. A support structure for a toilet cover unit claimed in claim 4, in which said toilet seat and said toilet lid are constructed so as to be pivotably linked to each other.

6. A support structure for a toilet cover unit claimed in claim 1, in which said pivotal support component and said rotational-force resistance means comprise a first resistant support means which pivotably supports said toilet seat to said support main body and a second resistant support means which pivotably supports said toilet lid to said toilet seat and is arranged on said same shaft core as said first resistance support means.

7. A support structure for a toilet cover unit claimed in claim 6, in which said resistance forces of said first and second resistance support means are set so that said toilet lid pivoting speed generated by said resistant force of said second resistant support means is slower than said toilet seat pivoting speed generated by said resistant force of said first resistant support means.

8. A support structure for a toilet cover unit claimed in claim 3, in which said rotational-force resistance means comprises at least one spring which increases said resistant force by pivotal movement of said toilet cover unit in said lowering direction and in which said resistant force is stored in said at least one spring where said toilet cover unit is fully lowered to said toilet bowl main body.

9. A toilet apparatus comprising a support main body secured to an upper end of a toilet bowl, a toilet cover plate which covers an upper portion of said toilet bowl, a hinge arrangement positioned between said support main body and said toilet cover plate which pivotably supports said toilet cover plate, said hinge arrangement comprising:

a rotational force resistance means attached to said support main body for generating a resistance force; and an engagement/disengagement unit disposed between said rotational force resistance means and said toilet cover plate, wherein said engagement/disengagement unit pivotably supports said toilet cover plate in such a way that said resistance force generated by said rotational force resistance means is transferred to said toilet cover plate responsive to a pivotal movement in a lowering direction of said toilet cover plate, said engagement/disengagement unit permits disengagement of said toilet cover plate from said support main body only when said toilet cover plate is positioned at a prescribed angle relative to said toilet bowl.

10. A toilet apparatus in accordance with claim 9, wherein said hinge arrangement further includes a support means positioned on an outer surface of said engagement/disengagement unit, said support means rotatably supports said toilet cover plate, said support means is also capable of disengaging said toilet cover plate from said support main body at said prescribed angle.

11. A toilet apparatus in accordance with claim 9, in which said prescribed angle is approximately 90 degrees.

12. A toilet apparatus in accordance with claim 9, in which said rotational-force resistance means includes at least one spring which increases said resistant force by pivotal movement of said toilet cover plate in said lowering direction and in which said resistant force is stored in said at least one spring where said toilet cover plate is fully lowered to said upper portion of said toilet bowl.

13. A toilet apparatus in accordance with claim 9, wherein said hinge arrangement comprises a support means positioned on an outer portion of said engagement/disengagement unit, said support means rotatably supports said toilet cover plate, said support means also being adaptable to disengage said toilet cover plate from said support main body at said prescribed angle.

* * * * *